US011865673B2

(12) United States Patent
Jangu et al.

(10) Patent No.: US 11,865,673 B2
(45) Date of Patent: Jan. 9, 2024

(54) ABRASIVE ARTICLE

(71) Applicant: 3M INNOVATIVE PROPERTIES COMPANY, St. Paul, MN (US)

(72) Inventors: Chainika Jangu, Mountain View, CA (US); Michael J. Annen, Hudson, WI (US); Deborah J. Eilers, Hastings, MN (US); David M. Mahli, Woodbury, MN (US); Caroline E. Morel, St. Paul, MN (US); Kathleen S. Shafer, Woodbury, MN (US); Gregory P. Sorenson, Maplewood, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 427 days.

(21) Appl. No.: 16/770,652

(22) PCT Filed: Dec. 6, 2018

(86) PCT No.: PCT/IB2018/059739
§ 371 (c)(1),
(2) Date: Jun. 8, 2020

(87) PCT Pub. No.: WO2019/111215
PCT Pub. Date: Jun. 13, 2019

(65) Prior Publication Data

US 2021/0170547 A1 Jun. 10, 2021

Related U.S. Application Data

(60) Provisional application No. 62/596,279, filed on Dec. 8, 2017.

(51) Int. Cl.
*B24D 3/28* (2006.01)
*B24D 11/00* (2006.01)
(Continued)

(52) U.S. Cl.
CPC ..... *B24D 3/28* (2013.01); *B24D 11/001* (2013.01); *B24D 3/004* (2013.01); *B24D 11/02* (2013.01); *B24D 2203/00* (2013.01)

(58) Field of Classification Search
CPC ..... B24D 3/28; B24D 3/004; B24D 11/001; B24D 11/02
See application file for complete search history.

(56) References Cited

U.S. PATENT DOCUMENTS 4,314,827 A 2/1982 Leitheiser et al.
4,623,364 A 11/1986 Cottringer et al.
(Continued)

FOREIGN PATENT DOCUMENTS

EP 1559510 A1 8/2005
FR 1485383 6/1967
(Continued)

OTHER PUBLICATIONS

Encyclopedia of Polymer Science and Engineering, vol. 6, John Wiley & Sons, 1986, pp. 322-382.
(Continued)

*Primary Examiner* — Pegah Parvini
(74) *Attorney, Agent, or Firm* — Aleksander Medved

(57) ABSTRACT

The disclosure relates to layers comprising a body having a thickness, T, comprising a curable composition comprising a polymerizable epoxy-acrylate resin composition and abrasive particles at least partially embedded in the polymerizable epoxy-acrylate resin composition, wherein the body includes a plurality of void spaces free of the curable composition extending into the body from the first major surface and the depth of the plurality of void spaces is at least 10 percent of thickness T. The disclosure also relates to cured compositions formed from such curable compositions
(Continued)

and, in turn, abrasive articles made from such cured compositions as well as methods for making abrasive articles.

21 Claims, 3 Drawing Sheets

(51) Int. Cl.
*B24D 3/00* (2006.01)
*B24D 11/02* (2006.01)

(56) References Cited

U.S. PATENT DOCUMENTS

| | | | |
|---|---|---|---|
| 4,652,275 | A | 3/1987 | Bloecher et al. |
| 4,744,802 | A | 5/1988 | Schwabel |
| 4,770,671 | A | 9/1988 | Monroe et al. |
| 4,799,939 | A | 1/1989 | Bloecher et al. |
| 4,848,041 | A | 7/1989 | Kruschke |
| 4,881,951 | A | 11/1989 | Wood et al. |
| 5,152,917 | A | 10/1992 | Pieper et al. |
| 5,201,916 | A | 4/1993 | Berg et al. |
| 5,213,591 | A | 5/1993 | Celikkaya et al. |
| 5,372,620 | A | 12/1994 | Rowse et al. |
| 5,435,816 | A | 7/1995 | Spurgeon et al. |
| RE35,570 | E | 7/1997 | Rowenhorst et al. |
| 5,672,097 | A | 9/1997 | Hoopman |
| 5,700,302 | A | 12/1997 | Stoetzel et al. |
| 5,804,610 | A | 9/1998 | Hamer et al. |
| 5,929,760 | A | 7/1999 | Monahan |
| 5,946,991 | A | 9/1999 | Hoopman |
| 5,975,987 | A | 11/1999 | Hoopman et al. |
| 5,984,998 | A | 11/1999 | Ottesen et al. |
| 6,129,540 | A | 10/2000 | Hoopman et al. |
| 6,183,677 | B1 | 2/2001 | Usui et al. |
| 7,947,097 | B2 | 5/2011 | You |
| 8,034,137 | B2 | 10/2011 | Erickson et al. |
| 8,142,531 | B2 | 3/2012 | Adefris et al. |
| 8,142,532 | B2 | 3/2012 | Erickson et al. |
| 8,142,891 | B2 | 3/2012 | Culler et al. |
| 2002/0182955 | A1 | 12/2002 | Weglewski et al. |
| 2006/0135050 | A1 | 6/2006 | Petersen et al. |
| 2007/0066198 | A1* | 3/2007 | Rambosek ..... B01D 46/10 451/533 |
| 2008/0148650 | A1* | 6/2008 | You ..... B24D 11/02 51/298 |
| 2009/0165394 | A1 | 7/2009 | Culler et al. |
| 2009/0169816 | A1 | 7/2009 | Erickson et al. |
| 2012/0227333 | A1 | 9/2012 | Adefris et al. |
| 2013/0040537 | A1 | 2/2013 | Schwabel et al. |
| 2013/0125477 | A1 | 5/2013 | Adefris |
| 2013/0344786 | A1 | 12/2013 | Keipert |
| 2015/0267097 | A1 | 9/2015 | Rosenflanz et al. |
| 2016/0295922 | A1* | 10/2016 | John ..... H05B 3/10 |
| 2016/0311084 | A1 | 10/2016 | Culler et al. |

FOREIGN PATENT DOCUMENTS

| | | |
|---|---|---|
| WO | WO 1998-12021 | 3/1998 |
| WO | 9956913 A1 | 11/1999 |
| WO | WO 2006/083688 | 8/2006 |
| WO | 2007002338 A2 | 1/2007 |
| WO | WO 2008-079934 | 7/2008 |
| WO | WO 2013-101575 | 7/2013 |
| WO | WO 2016-160357 | 10/2016 |
| WO | WO 2016-195970 | 12/2016 |
| WO | WO 2016-196561 | 12/2016 |
| WO | WO 2017-095704 | 6/2017 |
| WO | WO 2018-106587 | 6/2018 |
| WO | WO 2019-111215 | 6/2019 |

OTHER PUBLICATIONS

Lee, Handbook of Epoxy Resins, McGraw-Hill Book Company, 1967, 3 pages.

International Search Report for PCT International Application No. PCT/IB2018/059739, dated Apr. 4, 2019, 5 pages.

* cited by examiner

ABRASIVE ARTICLE

CROSS REFERENCE TO RELATED APPLICATIONS

This application is a national stage filing under 35 U.S.C. 371 of PCT/IB2018/059739, filed Dec. 6, 2018, which claims the benefit of U.S. Provisional Application No. 62/596,279, filed Dec. 8, 2017, the disclosures of which are incorporated by reference in their entireties herein.

BACKGROUND

Abrasive articles are used for the removal of stock from a substrate. Properties that can affect the performance of the abrasive articles include mineral type and size, make coat, size coat and super size coat types, backing types and the like. Flexible abrasives enable the efficient and uniform sanding of contoured areas. Existing flexible coated abrasive products are supported on a paper or polymer backing before they are attached to a backing pad or used for hand-sanding. Furthermore, there are several challenges working with existing products. For example, wet or dry abrasive with a paper backing is flexible when soaked in water, but the cleanup is time-consuming. There is therefore an unmet need for flexible abrasives that meet performance requirements, but do not succumb to the disadvantages of existing products.

BRIEF DESCRIPTION OF THE DRAWINGS

The drawings illustrate generally, by way of example, but not by way of limitation, various embodiments discussed in the present document.

It should be understood that numerous other modifications and examples can be devised by those skilled in the art, which fall within the scope and spirit of the principles of the disclosure. Figures may not be drawn to scale.

DESCRIPTION

Abrasive products are used to sand a wide variety of substrates, including soft, difficult to finish materials such as painted surfaces. The applications for coated abrasives for the collision repair market are very wide and include cleaning, coating removal, filler shaping, metal shaping, paint stripping to metal, primer sanding, paint preparation, paint finishing etc. Abrasive products can, in some instances, comprise a make coat, mineral, a size coat, and a super-size coat.

Some abrasives currently in production employ epoxy-acrylate hybrid chemistry to prepare the make coat to manufacture coated abrasives. But there are some challenges to existing coated abrasives. For example, current make resin coating on paper and film backings is very brittle. In addition, due to the low viscosity of the resin, it fills the fibers of porous cloth backings making the construction brittle, and less pliable, which has some limitations for coated abrasives. Further, existing make-coats exhibit poor adhesion with untreated backings. Thus, processing of backings is required to increase the adhesion with the make resin, which adds to the cost and complexity in manufacturing.

Figure 1:
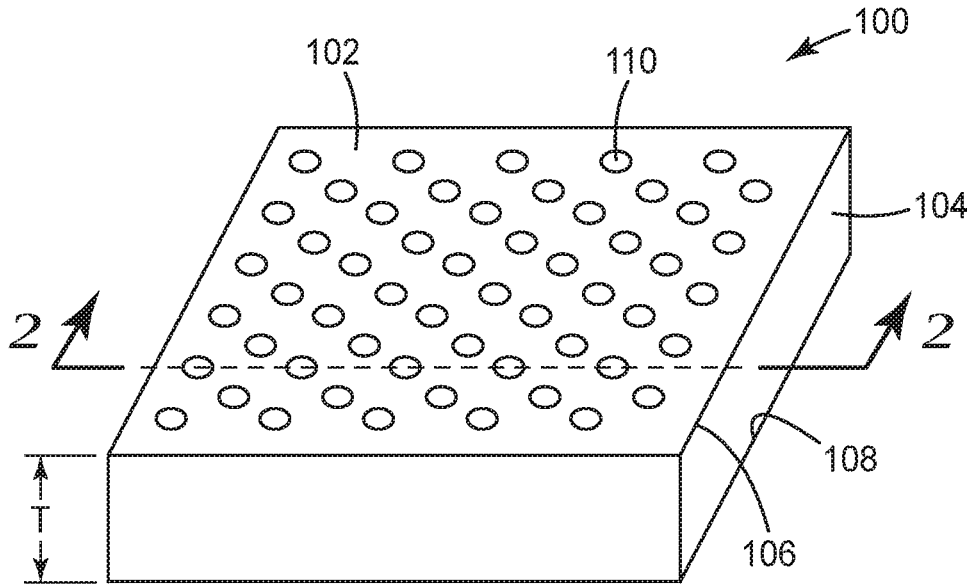
FIG. 1 is a perspective view of an abrasive article according to one example of the present disclosure.

Described herein are abrasive articles comprising polymerizable (e.g., photopolymerizable) epoxy-acrylate resin compositions as toughened make compositions for next generation coated abrasives. As demonstrated herein, these new make resin compositions form a self-supporting abrasive layer that can serve as both make and backing layers for an abrasive article. This means that expensive backings currently used in coated abrasives can be avoided, and opens up opportunities for new cost-advantaged constructs, particularly in the area of flexible abrasive articles. FIG. 1 is a perspective view of one example of an abrasive article referred to by the numeral 100. As shown, the abrasive article 100 includes: abrasive layer 102, the abrasive layer comprising a body 104 having a thickness, T, the body 104 comprising: a first major surface 106; and a second major surface 108 opposite the first major surface 106; the body 104 comprising a curable composition comprising: (a) a polymerizable epoxy-acrylate resin composition; and (b) abrasive particles (not shown) at least partially embedded in the polymerizable epoxy-acrylate resin composition; and wherein the body 104 includes a plurality of void spaces 110 free of the curable composition extending into the body 104 from the first major surface 106. In some embodiments, the curable composition may be polymerized and the body then includes the polymerization product of the curable composition (i.e. a polymerized epoxy-acrylate resin composition and abrasive particles), wherein the body includes a plurality of void spaces free of the polymerization product of the curable composition and the depth of the plurality of void spaces is at least 10 percent of thickness T.

Figure 2:
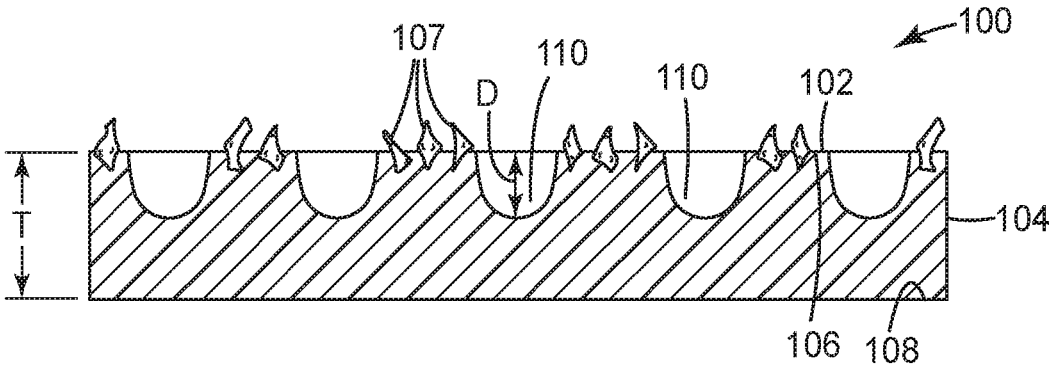
FIGS. 2-4 are side cross-sectional views of abrasive articles according to various exemplary embodiments of the present disclosure.

FIG. 2 shows a cross-section of an abrasive article referred to by the numeral 100 taken on the line 2-2 of FIG. 1 looking in the direction of the arrows. As shown in FIG. 2, the abrasive article 100 includes: abrasive layer 102, the abrasive layer comprising a body 104 having a thickness, T, the body 104 comprising: a first major surface 106; and a second major surface 108 opposite the first major surface 106; the body 104 comprising a curable composition comprising: (a) a polymerizable epoxy-acrylate resin composition; and (b) abrasive particles 107 at least partially embedded in the polymerizable epoxy-acrylate resin composition; and wherein the body 104 includes a plurality of void spaces 110, having a depth D and being free of the curable composition, extending into the body 104 from the first major surface 106. The depth (D) of the plurality of void spaces 110 is at least about 10% of thickness T (e.g., at least about 20%, at least about 30%, at least about 40%, at least about 50%, at least about 60%, at least about 80%, about 100%, about 10% to about 100%, about 20% to about 80%, about 50% to about 90% or about 70% to about 100% of thickness T). In some embodiments, at least a portion of the plurality of void spaces extend to the second major surface. In other embodiments, the plurality of void spaces forms a regular pattern (see, e.g., FIGS. 5 and 6 for examples of regular patterns) or an irregular pattern.

As used herein, the term "at least partially embedded" generally means that at least a portion of an abrasive particle is embedded in the cured composition, such that, the abrasive particle is anchored in the cured composition.

Figure 4:
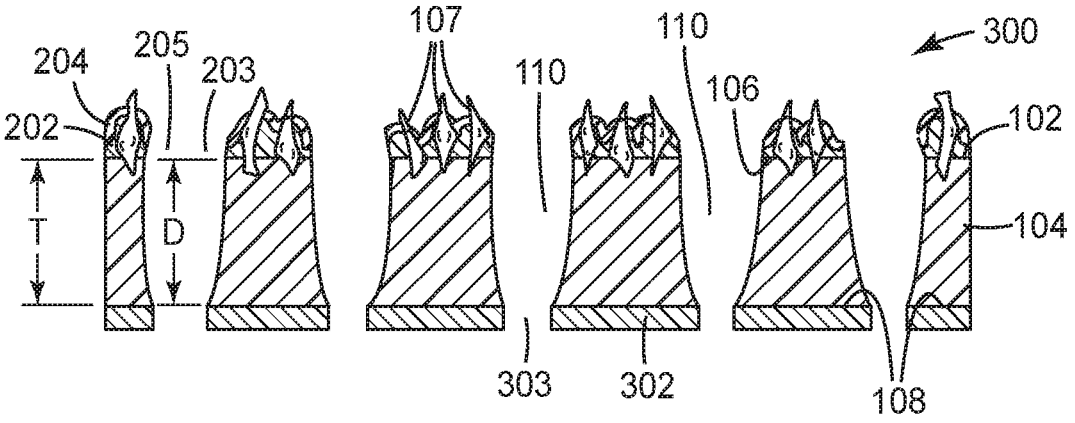
Figure 5:
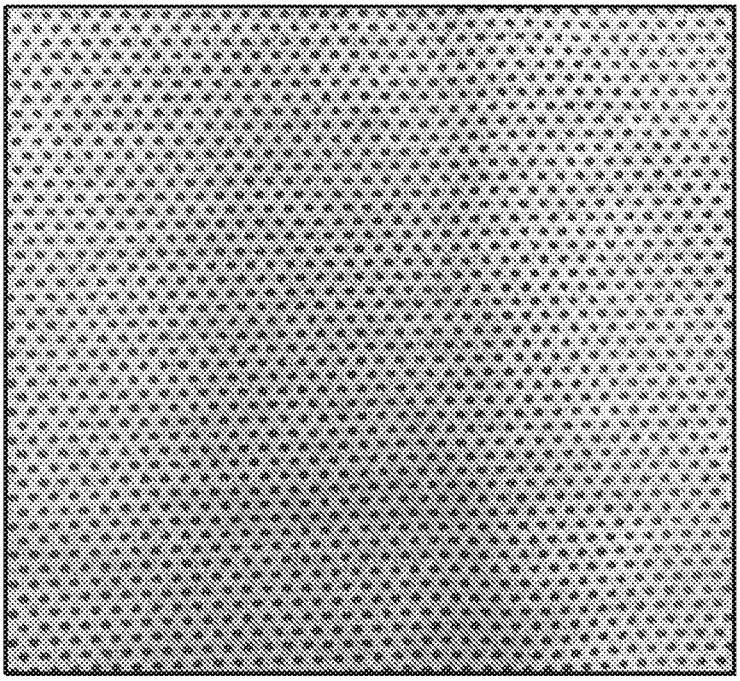
FIG. 5 is a top view of an abrasive article according to one embodiment of the present disclosure.

It should be clear from the abrasive article illustrated in FIG. 1, in contrast to the abrasive articles depicted in FIGS. 4-5, that the abrasive article lacks a backing. But a backing can be added to the abrasive article depicted in FIG. 1 to arrive, for example, at an abrasive article such as the one depicted in FIGS. 4-5. In another example, the abrasive article 100 can comprise an attachment layer (not shown) that is one part of a hook-and-loop attachment mechanism.

Figure 3:
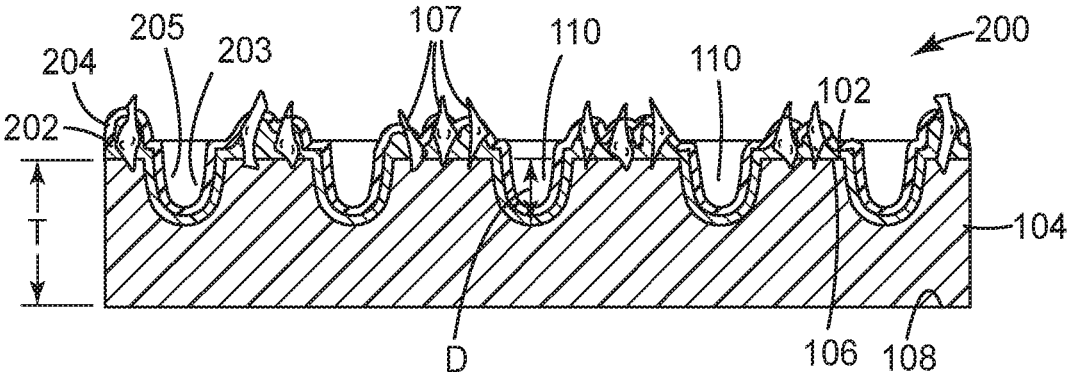

FIG. 3 shows one example of an abrasive article referred to by the numeral 200, which incorporates all of the features shown in FIG. 2, which will not be discussed again for the sake of brevity, but also a size coat 202 having size coat void spaces 203, and a supersize coat 204 having supersize coat void spaces 205. It should be clear from the abrasive article illustrated in FIG. 3, in contrast to the abrasive articles depicted in FIGS. 4-5, that the abrasive article lacks a backing. But a backing can be added to the abrasive article depicted in FIG. 3 to arrive, for example, at an abrasive article such as the one depicted in FIGS. 4-5.

FIG. 4 shows one example of an abrasive article referred to by the numeral 300, which incorporates all of the features shown in FIGS. 2 and 3, which will not be discussed again for the sake of brevity, but also an optional backing 302 having backing void spaces 303. In FIG. 4, the void spaces 110 extend from the first major surface 106 to the second major surface 108. In that case the thickness T is equal to the depth D. In some embodiments, the backing 302 is absent. In still other embodiments, a polymeric compressible foam can be interposed between the backing 302 and the attachment layer. Optionally but not shown, one or more additional layers could be disposed between any of the above layers to help adhere layers to each other, provide a printed image, act as a barrier layer, or serve any other purpose known in the art. In some embodiments, by providing compressibility to the abrasive article 300, the compressible foam can enable a more uniform contact with the workpiece to be abraded, and particularly so where the workpiece has non-planar contours. As a further option, the backing 302 and compressible foam could be consolidated into a single layer that serves both functions.

In another example, the abrasive articles of the present disclosure, e.g. abrasive articles 100, 200 and 300, can comprise an attachment layer (not shown) that may be one part of a hook-and-loop attachment mechanism. In another example, the attachment layer (not shown) may be a removable pressure-sensitive adhesive. In some embodiments, the attachment layer may be adjacent to or in contact with second major surface 108, for example. In some embodiments, the attachment layer may be adjacent to or in contact with the exposed surface of backing 302, for example.

In some embodiments, the abrasive articles of the various embodiments described herein comprise at least one of a size coat, a supersize coat, and a backing, wherein the size coat, supersize coat, or the backing comprise size coat void spaces, supersize coat void spaces, or backing void spaces, respectively, that substantially overlap with the plurality of void spaces of the abrasive layer.

The layer configurations described above are not intended to be exhaustive, and it is to be understood that layers can be added or removed with respect to any of the examples depicted in FIGS. 1-4.

The abrasive layer of the abrasive article of the various embodiments described herein is made from a curable composition. In some instances, therefore, this specification makes reference to cured or uncured compositions, where the cured composition is synonymous with the abrasive layer.

Making reference to FIG. 1, some embodiments are directed to an abrasive layer 102 for an abrasive article, the abrasive layer 102 comprising: a body 104 comprising: a first major surface 106; a second major surface 108 opposite the first major surface 106; wherein the body 104 comprises the polymerization product of the curable composition of the various embodiments described herein; and wherein the body 104 includes a plurality of void spaces 110 free of the polymerization product of the curable composition (i.e. free of the polymerized epoxy-acrylate resin composition and abrasive particles 107, see FIG. 2), the void spaces 110 extending into the body 104 from the first major surface 106. In some embodiments, the body includes a plurality of void spaces free of the curable composition extending into the body from the first major surface, and the depth of the plurality of voids is at least 10 percent of thickness T (e.g., at least about 20%, at least about 30%, at least about 40%, at least about 50%, at least about 60%, at least about 80%, about 100%, about 10% to about 100%, about 20% to about 80%, about 50% to about 90% or about 70% to about 100% of thickness T). In other embodiments, at least a portion of the plurality of void spaces extend to the second major surface.

In some examples, the curable composition comprises a polymerizable epoxy-acrylate resin composition having a complex viscosity at 125° C. and 1 Hz frequency of about 10 Pa-s to about 10,000 Pa-s; and abrasive particles at least partially embedded in the polymerizable epoxy-acrylate resin composition. In some specific examples, the cured composition/abrasive layer is the photopolymerization product of the curable composition. And, in some instances, in addition to the complex viscosity at 125° C. and 1 Hz frequency of about 10 Pa-s to about 10,000 Pa-s, the curable composition also has a complex viscosity at 25° C. and 1 Hz frequency of about 1,000 Pa-s to about 100,000 Pa-s.

In some embodiments, the curable composition has a complex viscosity at 125° C. and 1 Hz frequency of at least about 10 Pa-s, at least about 50 Pa-s, at least about 100 Pa-s, at least about 1,000 Pa-s, at least about 2,000 Pa-s, at least about 3,000 Pa-s, at least about 5,000 Pa-s, or at least about 6,000 Pa-s. In some examples, the polymerizable epoxy-acrylate resin composition has a complex viscosity at 125° C. and 1 Hz frequency of up to about 1,000 Pa-s, up to about 2,000 Pa-s, up to about 3,000 Pa-s, up to about 5,000 Pa-s, up to about 6,000 Pa-s, up to about 8,000 Pa-s or up to about 10,000 Pa-s. In still other examples, the polymerizable epoxy-acrylate resin composition has a complex viscosity at 125° C. and 1 Hz frequency of about 10 Pa-s to about 10,000 Pa-s, about 10 Pa-s to about 5,000 Pa-s, about 10 Pa-s to about 1,000 Pa-s, about 10 Pa-s to about 100 Pa-s, about 50 Pa-s to about 500 Pa-s, about 100 Pa-s to about 1000 Pa-s about 1000 Pa-s to about 8000 Pa-s, about 2000 Pa-s to about 5,000 Pa-s, about 500 Pa-s to about 3,000 Pa-s, about 2,000 Pa-s to about 7000 Pa-s or about 3,000 Pa-s to about 10,000 Pa-s.

In some examples, the polymerizable epoxy-acrylate resin composition also has a complex viscosity at 25° C. and 1 Hz frequency of at least about 1000 Pa-s, at least about 4000 Pa-s, at least about 8000 Pa-s, at least about 10,000 Pa-s, at least about 12,000 Pa-s, at least about 20,000 Pa-s, at least about 50,000 Pa-s, or at least about 80,000 Pa-s. In some examples, the polymerizable epoxy-acrylate resin composition has a complex viscosity at 25° C. and 1 Hz frequency of up to about 100,000 Pa-s, up to about 10,000 Pa-s, up to about 12,000 Pa-s, up to about 15,000 Pa-s, up to about 30,000 Pa-s, up to about 50,000 Pa-s or up to about 80,000 Pa-s. In still other examples, the polymerizable epoxy-acrylate resin composition has a complex viscosity at 25° C. and 1 Hz frequency of about 1000 Pa-s to about 100,000 Pa-s, about 1000 Pa-s to about 20000 Pa-s, about 6000 Pa-s to about 15,000 Pa-s, about 8000 Pa-s to about 30,000 Pa-s, about 20,000 Pa-s to about 80,000 Pa-s or about 30,000 Pa-s to about 60,000 Pa-s.

In some examples, the polymerizable epoxy-acrylate resin composition has a storage modulus (G') at 25° C. and 1 Hz frequency of at least about 1,000 Pa, at least about 5,000 Pa, at least about 10,000 Pa or at least 30,000 Pa. In some examples, the polymerizable epoxy-acrylate resin composition has a G' at 25° C. and 1 Hz frequency of up to about 20,000 Pa, up to about 50,000 Pa, up to about 100,000 Pa or up to about 300,000 Pa. In still other examples, the polymerizable epoxy-acrylate resin composition has a G' at 25° C. and 1 Hz frequency of about 5000 Pa to about 300,000 Pa, 10,000 Pa to about 100,000 Pa, about 10,000 Pa to about 80,000 Pa, about 8,000 Pa to about 80,000 Pa or about 25,000 Pa to about 75,000 Pa.

In some examples, the polymerizable epoxy-acrylate resin composition has a loss modulus (G") at 25° C. and 1 Hz frequency of at least about 5,000 Pa, at least about 7,500 Pa, at least about 10,000 Pa or at least 20,000 Pa. In some examples, the curable composition has a G" at 25° C. and 1 Hz frequency of up to about 300,000 Pa, up to about 100,000 Pa, up to about 80,000 Pa or up to about 60,000 Pa. In still other examples, the curable composition has a G" at 25° C. and 1 Hz frequency of about 5000 Pa to about 300,000 Pa, 10,000 Pa to about 100,000 Pa, about 10,000 Pa to about 80,000 Pa, about 8,000 Pa to about 80,000 Pa or about 25,000 Pa to about 75,000 Pa.

In some examples, the polymerizable epoxy-acrylate resin composition has a loss tangent (tan(δ)) at 125° C. and 1 Hz frequency of at least about 0.80, at least about 1.00, at least about 1.25, at least about 1.50, or at least about 2.00. In some examples, the polymerizable epoxy-acrylate resin composition has a loss tangent, tan(δ), at 125° C. and 1 Hz frequency of up to about 5.00, up to about 4.00, up to about 3.00, up to about 2.75, or up to about 2.50. In still other examples, the curable composition has a loss tangent (tan(δ)) at 125° C. and 1 Hz frequency of about 0.80 to about 5.00, of about 1.00 to about 3.00, or of about 2.00 to about 3.00.

In some examples, a 10 cm×5 cm×0.07 mm film (the film can be of any suitable dimension, however) formed from curing the polymerizable epoxy-acrylate resin composition has a G' at 25° C. and 1 Hz frequency of at least about 300 MPa, at least about 400 MPa, at least about 600 MPa or at least about 800 MPa. In some examples, the cured polymerizable epoxy-acrylate resin composition has a G' of up to about 400 MPa, up to about 500 MPa, or up to about 950 MPa. In some examples, a 10 cm×5 cm×0.07 mm film (the film can be of any suitable dimension, however) formed from the cured polymerizable epoxy-acrylate resin composition has a G' of about 300 MPa to about 950 MPa; about 400 MPa to about 800 MPa; or about 300 MPa to about 600 MPa.

In some examples, a 10 cm×5 cm×0.07 mm film (the film can be of any suitable dimension, however) formed from curing the polymerizable epoxy-acrylate resin composition has a G" at 25° C. and 1 Hz frequency of at least about 100 MPa, at least about 200 MPa, at least about 250 MPa or at least about 350 MPa. In some examples, the cured polymerizable epoxy-acrylate resin composition has a G" of up to about 200 MPa, up to about 300 MPa, or up to about 400 MPa. In some examples, a 10 cm×5 cm×0.07 mm film (the film can be of any suitable dimension, however) formed from the cured polymerizable epoxy-acrylate resin composition has a G" of about 100 MPa to about 300 MPa; about 100 MPa to about 200 MPa; or about 150 MPa to about 250 MPa.

The complex viscosity, G', and G" measurements can be obtained using a TA Instruments Discovery HR-3 rheometer with 25 mm diameter steel parallel plate geometry to directly probe viscoelastic properties of the copolymers. Measurements can be performed at a constant nominal strain value within the linear viscoelastic regime, determined with strain sweeps (0.01 to 10.0% oscillatory strain) at 1 Hz. The samples were subjected to temperature ramp at 2.0° C./min, at a constant 1 Hz frequency.

In some embodiments, films (e.g., a 38 mm×50 mm×0.50 or 0.70 mm film, but the film can be of any suitable dimension, however) formed from curing the polymerizable epoxy-acrylate resin composition, having a plurality of voids free of the polymerizable epoxy-acrylate resin composition, have a stiffness of from about 0.01 to about 0.5 N-mm (e.g., about 0.01 to about 0.2 N-mm, about 0.01 to about 0.1 N-mm, about 0.05 to about 0.1 N-mm or about 0.05 to about 0.09 N-mm).

In some examples, a film (e.g., a 38 mm×50 mm×0.50 or 0.70 mm film, but the film can be of any suitable dimension, however) formed from curing the polymerizable epoxy-acrylate resin composition, having a plurality of voids free of the polymerized epoxy-acrylate resin composition, has a stiffness as determined using the methods described herein of no more than about 0.5 N-mm, no more than about 0.3 N-mm, no more than about 0.2 N-mm, no more than about 0.1 N-mm or no more than about 0.09 N-mm. In some examples, the cured polymerizable epoxy-acrylate resin composition, having a plurality of voids free of the polymerized epoxy-acrylate resin composition, has a stiffness of at least about 0.01 N-mm, at least about 0.05 N-mm, at least about 0.09 N-mm; at least about 0.1 N-mm or at least about 0.2 N-mm. In some examples, the cured polymerizable epoxy-acrylate resin composition, having a plurality of voids free of the polymerized epoxy-acrylate resin composition, has a stiffness of from about 0.01 to about 0.5 N-mm (e.g., about 0.01 to about 0.2 N-mm, about 0.01 to about 0.1 N-mm, about 0.05 to about 0.1 N-mm or about 0.05 to about 0.09 N-mm).

In some examples, a film (e.g., a 38 mm×50 mm×0.50 or 0.70 mm film, but the film can be of any suitable dimension, however) formed from curing the polymerizable epoxy-acrylate resin composition, having a plurality of voids free of the polymerized epoxy-acrylate resin composition, has a bending force as determined using the methods described herein of no more than about 1.5 N, no more than about 0.7 N, no more than about 0.5 N, no more than about 0.3 N or no more than about 0.1 N. In some examples, the cured polymerizable epoxy-acrylate resin composition, having a plurality of voids free of the polymerized epoxy-acrylate resin composition, has a bending force of at least about 0.2 N, at least about 0.5 N, at least about 0.7 N; at least about 0.9 N or at least about 1.0 N. In some examples, the cured polymerizable epoxy-acrylate resin composition, having a plurality of voids free of the polymerized epoxy-acrylate resin composition, has a bending force of from about 0.1 to about 1.5 N (e.g., about 0.2 to about 0.9 N, about 0.3 to about 0.5 N or about 0.4 to about 0.9 N).

In some examples, a film (e.g., a 38 mm×50 mm×0.50 or 0.70 mm film, but the film can be of any suitable dimension, however) formed from curing the polymerizable epoxy-acrylate resin composition, having a plurality of voids free of the polymerized epoxy-acrylate resin composition, has a force after holding time as determined using the methods described herein of no more than about 1.5 N, no more than about 0.7 N, no more than about 0.5 N, no more than about 0.3 N or no more than about 0.1 N. In some examples, the cured polymerizable epoxy-acrylate resin composition, having a plurality of voids free of the polymerized epoxy-acrylate resin composition, has a force after holding time of at least about 0.2 N, at least about 0.5 N, at least about 0.7 N; at least about 0.9 N or at least about 1.0 N. In some examples, the cured polymerizable epoxy-acrylate resin composition, having a plurality of voids free of the polymerized epoxy-acrylate resin composition, has a force after holding time of from about 0.1 to about 1.5 N (e.g., about 0.2 to about 0.9 N, about 0.3 to about 0.5 N or about 0.4 to about 0.9 N).

In some examples, a film (e.g., a 38 mm×50 mm×0.50 or 0.70 mm film, but the film can be of any suitable dimension, however) formed from curing the polymerizable epoxy-acrylate resin composition, having a plurality of voids free of the polymerized epoxy-acrylate resin composition, has a maximum force as determined using the methods described herein of no more than about 1.5 N, no more than about 0.7 N, no more than about 0.5 N, no more than about 0.3 N or no more than about 0.1 N. In some examples, the cured polymerizable epoxy-acrylate resin composition, having a plurality of voids free of the polymerized epoxy-acrylate resin composition, has a maximum force of at least about 0.2 N, at least about 0.5 N, at least about 0.7 N; at least about 0.9 N or at least about 1.0 N. In some examples, the cured polymerizable epoxy-acrylate resin composition, having a plurality of voids free of the polymerized epoxy-acrylate resin composition, has a maximum force of from about 0.1 to about 1.5 N (e.g., about 0.2 to about 0.9 N, about 0.3 to about 0.5 N or about 0.4 to about 0.9 N).

In some examples, the curable composition of the various embodiments described herein does not require heat for curing, although heat can be used to accelerate the curing process. Further, in some embodiments, the curable composition is prepared using a hot melt process, thereby avoiding the need for volatile solvents, since solvents are often undesirable because of costs associated with procurement, handling, and disposal.

Useful components in the curable composition that are used in the abrasive layer are enumerated and described in greater detail herein. In some examples, the curable composition of the various embodiments described herein comprises: i) from about 15 to about 50 parts by weight of the THF (meth)acrylate copolymer component; ii) from about 25 to about 50 parts by weight of the one or more epoxy resins; iii) from about 5 to about 15 parts by weight of the one or more hydroxy-functional polyethers; iv) in the range of from about 10 to about 25 parts by weight of at least one polyhydroxyl-containing compound; where the sum of i) to iv) is 100 parts by weight; and v) from about 0.1 to about 5 parts by weight of a photoinitiator, relative to the 100 parts of i) to iv).

In some embodiments, the polymerizable epoxy-acrylate resin component included in the curable composition comprises a tetrahydrofurfuryl (THF) (meth)acrylate copolymer component; one or more epoxy resins; and one or more hydroxy-functional polyethers.

The tetrahydrofurfuryl (THF) (meth)acrylate copolymer component is formed from a polymerizable mixture. Unless otherwise specified, THF acrylates and methacrylates will be abbreviated as THFA. More specifically, the curable composition comprises a THFA copolymer component formed from a polymerizable composition comprising one or more tetrahydrofurfuryl (meth)acrylate monomers, one or more $C_1$-$C_8$ (meth)acrylate ester monomers, one or more optional cationically reactive functional (meth)acrylate monomers, one or more chain transfer agents, and one or more photoinitiators.

The THFA copolymer component comprises a $C_1$-$C_8$ alkyl (meth)acrylate ester monomer. Useful monomers include the acrylates and methacrylate of methyl, ethyl, propyl, isopropyl, butyl, pentyl, hexyl, heptyl and octyl alcohols, including all isomers, and mixtures thereof. In some embodiments, the alcohol is selected from $C_3$-$C_6$ alkanols, and in certain embodiments, the carbon number molar average of the alkanols is $C_3$-$C_6$. It has been found that within this range the copolymer has sufficient miscibility with the epoxy resin component described herein.

In addition, the THFA copolymer component may contain a cationically reactive monomer (e.g., a (meth)acrylate monomer having a cationically reactive functional group). Examples of such monomers include, for example, glycidyl acrylate, glycidyl methacrylate, hydroxyethyl acrylate, hydroxyethyl methacrylate, hydroxypropyl methylacrylate, hydroxybutyl acrylate and alkoxysilylalkyl (meth)acrylates, such as trimethoxysilylpropyl acrylate.

In some embodiments, the copolymer is formed from a polymerizable mixture comprising one or more chain transfer agents that function to, among other things, control the molecular weight of the resultant THFA copolymer component. Examples of useful chain transfer agents include, but are not limited to, carbon tetrabromide, alcohols, mercaptans such as isooctylthioglycolate, and mixtures thereof. If used, the polymerizable mixture may include up to 0.5 weight of a chain transfer agent based on a total weight of polymerizable material. For example, the polymerizable mixture can contain 0.01 to 0.5 weight percent, 0.05 to 0.5 weight percent, or 0.05 to 0.2 weight percent chain transfer agent.

In some embodiments, the THFA copolymer component contains essentially no acid functional monomers, whose presence could initiate polymerization of the epoxy resin prior to UV curing of the curable composition. In some embodiments, the copolymer also does not contain any amine-functional monomers. Furthermore, in some embodiments, the copolymer does not contain any acrylic monomers having moieties sufficiently basic so as to inhibit cationic cure of a curable composition.

The THFA copolymer generally comprises polymerized monomer units of: (A) 40-60 wt % (e.g., 50-60 wt % and 45-55 wt %) of tetrahydrofurfuryl (meth)acrylate; (B) 40-60 wt % (e.g., 40-50 wt % and 45-55 wt %) of $C_1$-$C_8$ (e.g., $C_3$-$C_6$) alkyl (meth)acrylate ester monomers; and (C) 0-10 wt % (e.g., 1-5 wt %, 0-5 wt %, and 0-2 wt %) of cationically reactive functional monomers, wherein the sum of A)-C) is 100 wt %.

The curable compositions of the various embodiments described herein can comprise one or more THFA copolymers in various amounts, depending on the desired properties of the abrasive layer (cured and/or uncured). In some embodiments, the curable compositions comprise one or more THFA copolymers in an amount of from 15-50 parts (e.g., 25-35 parts), by weight based on 100 parts total weight of monomers/copolymers in the curable compositions.

The curable compositions may include one or more thermoplastic polyesters. Suitable polyester components include semi-crystalline polyesters as well as amorphous and branched polyesters. But in some embodiments, the curable compositions of the various embodiments described herein contain substantially no thermoplastic polyesters; no more than trace amounts of thermoplastic polyesters; or amounts that will not materially affect the characteristics of the curable compositions.

Thermoplastic polyesters may include polycaprolactones and polyesters having hydroxyl and carboxyl termination, and may be amorphous or semi-crystalline at room temperature. In some embodiments, the polyesters are hydroxyl terminated polyesters that are semi-crystalline at room temperature. A material that is "amorphous" has a glass transition temperature but does not display a measurable crystalline melting point as determined on a differential scanning calorimeter ("DSC"). In some embodiments, the glass transition temperature is less than about 100° C. A material that is "semi-crystalline" displays a crystalline melting point as determined by DSC, in some embodiments, with a maximum melting point of about 120° C.

Crystallinity in a polymer can also be reflected by the clouding or opaqueness of a sheet that had been heated to an amorphous state as it cools. When the polyester polymer is heated to a molten state and knife-coated onto a liner to form a sheet, it is amorphous and the sheet is observed to be clear and fairly transparent to light. As the polymer in the sheet material cools, crystalline domains form and the crystallization is characterized by the clouding of the sheet to a translucent or opaque state. The degree of crystallinity may be varied in the polymers by mixing in any compatible combination of amorphous polymers and semi-crystalline polymers having varying degrees of crystallinity. It is generally preferred that material heated to an amorphous state be allowed sufficient time to return to its semi-crystalline state before use or application. The clouding of the sheet provides a convenient non-destructive method of determining that crystallization has occurred to some degree in the polymer.

The polyesters may include nucleating agents to increase the rate of crystallization at a given temperature. Useful nucleating agents include microcrystalline waxes. A suitable wax could include an alcohol comprising a carbon chain having a length of greater than 14 carbon atoms (CAS #71770-71-5) or an ethylene homopolymer (CAS #9002-88-4) sold by Baker Hughes, Houston, TX, as UNILIN™ 700.

In some embodiments, the polyesters are solid at room temperature. The polyesters can have a number average molecular weight of about 7,500 g/mol to 200,000 g/mol (e.g., from about 10,000 g/mol to 50,000 g/mol and from about 15,000 g/mol to 30,000 g/mol).

Polyesters useful for use in the curable compositions of the various embodiments described herein comprise the reaction product of dicarboxylic acids (or their diester equivalents) and diols. The diacids (or diester equivalents) can be saturated aliphatic acids containing from 4 to 12 carbon atoms (including branched, unbranched, or cyclic materials having 5 to 6 carbon atoms in a ring) and/or aromatic acids containing from 8 to 15 carbon atoms. Examples of suitable aliphatic acids are succinic, glutaric, adipic, pimelic, suberic, azelaic, sebacic, 1,12-dodecanedioic, 1,4-cyclohexanedicarboxylic, 1,3-cyclopentanedicarboxylic, 2-methylsuccinic, 2-methylpentanedioic, 3-methylhexanedioic acids, and the like. Suitable aromatic acids include terephthalic acid, isophthalic acid, phthalic acid, 4,4'-benzophenone dicarboxylic acid, 4,4'-diphenylmethanedicarboxylic acid, 4,4'-diphenylthioether dicarboxylic acid, and 4,4'-diphenylamine dicarboxylic acid. In some embodiments, the structure between the two carboxyl groups in the diacids contain only carbon and hydrogen atoms. In some specific embodiments, the structure between the two carboxyl groups in the diacids is a phenylene group. Blends of the foregoing diacids may be used.

The diols include branched, unbranched, and cyclic aliphatic diols having from 2 to 12 carbon atoms. Examples of suitable diols include ethylene glycol, 1,3-propylene glycol, 1,2-propylene glycol, 1,4-butanediol, 1,3-butanediol, 1,5-pentanediol, 2-methyl-2,4-pentanediol, 1,6-hexanediol, cyclobutane-1,3-di(2'-ethanol), cyclohexane-1,4-dimethanol, 1,10-decanediol, 1,12-dodecanediol, and neopentyl glycol. Long chain diols including poly(oxyalkylene)glycols in which the alkylene group contains from 2 to 9 carbon atoms (e.g., 2 to 4 carbon atoms), may also be used. Blends of the foregoing diols may be used.

Useful, commercially available hydroxyl terminated polyester materials include various saturated linear, semi-crystalline copolyesters available from Evonik Industries, Essen, North Rhine-Westphalia, Germany, such as DYNAPOL™ S1401, DYNAPOL™ S1402, DYNAPOL™ S1358, DYNAPOL™ S1359, DYNAPOL™ S1227, and DYNAPOL™ S1229. Useful saturated, linear amorphous copolyesters available from Evonik Industries include DYNAPOL™ 1313 and DYNAPOL™ S1430.

The curable compositions may include one or more thermoplastic polyesters in an amount that varies depending on the desired properties of the abrasive layer. In some embodiments, the curable compositions include one or more thermoplastic polyesters in an amount of up to 50 percent by weight, based on the total weight of monomers/copolymers in the curable compositions. Where present, the one or more thermoplastic polyesters are present, in some embodiments, in an amount of at least 5 percent, at least 10 percent, at least 12 percent, at least 15 percent, or at least 20 percent by weight based on the total weight of monomers/copolymers in the composition. Where present, the one or more thermoplastic polyesters are, in some embodiments, present in an amount of at most 20 percent, at most 25 percent, at most 30 percent, at most 40 percent, or at most 50 percent by weight based on the total weight of monomers/copolymers in the curable compositions.

In some embodiments, the curable compositions comprise one or more epoxy resins, which are polymers comprising at least one epoxide functional group. Epoxy resins or epoxides that are useful in the composition of the present disclosure may be any organic compound having at least one oxirane ring that is polymerizable by ring opening. In some examples, the average epoxy functionality in the epoxy resins is greater than one, and, in some instances, at least two. The epoxides can be monomeric or polymeric, and aliphatic, cycloaliphatic, heterocyclic, aromatic, hydrogenated, or mixtures thereof. In some examples, epoxides contain more than 1.5 epoxy group per molecule and, in some instances, at least 2 epoxy groups per molecule. The useful materials typically have a weight average molecular weight of 150 g/mol to 10,000 g/mol (e.g., 180 g/mol to 1,000 g/mol). The molecular weight of the epoxy resin can be selected to provide the desired properties of the curable compositions or the cured compositions. Suitable epoxy resins include linear polymeric epoxides having terminal epoxy groups (e.g., a diglycidyl ether of a polyoxyalkylene glycol), polymeric epoxides having skeletal epoxy groups (e.g., polybutadiene poly epoxy), and polymeric epoxides having pendant epoxy groups (e.g., a glycidyl methacrylate polymer or copolymer), and mixtures thereof. The epoxide-containing materials include compounds having the general formula:

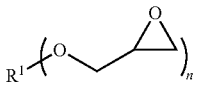

wherein $R^1$ is alkyl, alkoxy or aryl and n is an integer from 1 to 6.

Epoxy resins include aromatic glycidyl ethers, e.g., such as those prepared by reacting a polyhydric phenol with an excess of epichlorohydrin, cycloaliphatic glycidyl ethers, hydrogenated glycidyl ethers, and mixtures thereof. Such polyhydric phenols may include resorcinol, catechol, hydroquinone, and the polynuclear phenols such as p,p'-dihydroxydibenzyl, p,p'-dihydroxydiphenyl, p,p'-dihydroxyphenyl sulfone, p,p'-dihydroxybenzophenone, 2,2'-dihydroxy-1,1-dinaphthylmethane, and the 2,2', 2,3', 2,4', 3,3', 3,4', and 4,4' isomers of dihydroxydiphenylmethane, dihydroxydiphenyldimethylmethane, dihydroxydiphenylethylmethylmethane, dihydroxydiphenylmethylpropylmethane, dihydroxydiphenylethylphenylmethane, dihydroxydiphenylpropylphenylmethane, dihydroxydiphenylbutylphenylmethane, dihydroxydiphenyltolylethane, dihydroxydiphenyltolylmethylmethane, dihydroxydiphenyldicyclohexylmethane, and dihydroxydiphenylcyclohexane.

Also useful are polyhydric phenolic formaldehyde condensation products as well as polyglycidyl ethers that contain as reactive groups only epoxy groups or hydroxy groups. Useful curable epoxy resins are also described in various publications including, for example, Lee and Nevil, Handbook of Epoxy Resins (McGraw-Hill Book Co. 1967) and Encyclopedia of Polymer Science and Technology, 6, p. 322 (1986).

The choice of the epoxy resin used can depend upon its intended end use. For example, epoxides with "flexible backbones" may be desired where a greater amount of ductility is needed. Materials such as diglycidyl ethers of bisphenol A and diglycidyl ethers of bisphenol F can provide desirable structural properties that these materials attain upon curing, while hydrogenated versions of these epoxies may be useful for compatibility with substrates having oily surfaces.

Examples of commercially available epoxides useful in the present disclosure include diglycidyl ethers of bisphenol A (e.g., those available under the trade names EPON™ 828, EPON™ 1001, EPON™ 1004, EPON™ 2004, EPON™ 1510, and EPON™ 1310 from Momentive Specialty Chemicals, Inc., Waterford, NY; those under the trade designations D.E.R.™ 331, D.E.R.™ 332, D.E.R.™ 334, and D.E.N.™ 439 available from Dow Chemical Co., Midland, MI; and those available under the trade name EPONEX™ 1510 available from Hexion); diglycidyl ethers of bisphenol F (that are available, e.g., under the trade designation ARALDITE™ GY 281 available from Huntsman Corporation); silicone resins containing diglycidyl epoxy functionality; flame retardant epoxy resins (e.g., that are available under the trade designation D.E.R.™ 560, a brominated bisphenol type epoxy resin available from Dow Chemical Co.); and 1,4-butanediol diglycidyl ethers.

Epoxy containing compounds having at least one glycidyl ether terminal portion, and in some instances, a saturated or unsaturated cyclic backbone may optionally be added to the curable compositions as reactive diluents. Reactive diluents may be added for various purposes such as to aid in processing, e.g., to control the viscosity in the curable compositions as well as during curing, make the cured composition more flexible, and/or compatibilize materials in the composition.

Examples of such diluents include: diglycidyl ether of cyclohexanedimethanol, diglycidyl ether of resorcinol, p-tert-butyl phenyl glycidyl ether, cresyl glycidyl ether, diglycidyl ether of neopentyl glycol, triglycidyl ether of trimethylolethane, triglycidyl ether of trimethylolpropane, triglycidyl p-amino phenol, N,N'-diglycidylaniline, N,N,N'N'-tetraglycidyl meta-xylylene diamine, and vegetable oil polyglycidyl ether. Reactive diluents are commercially available as HELOXY™ 107 and CARDURA™ N10 from Momentive Specialty Chemicals, Inc. The composition may contain a toughening agent to aid in providing, among other features, peel resistance and impact strength.

The curable compositions can contain one or more epoxy resins having an epoxy equivalent weight of from 100 g/mol to 1500 g/mol. In some instances, the curable compositions contain one or more epoxy resins having an epoxy equivalent weight of from 300 g/mol to 1200 g/mol. And in other embodiments, the curable compositions of the various embodiments described herein contain two or more epoxy resins, wherein at least one epoxy resin has an epoxy equivalent weight of from 300 g/mol to 500 g/mol, and at least one epoxy resin has an epoxy equivalent weight of from 1000 g/mol to 1200 g/mol.

The curable compositions may comprise one or more epoxy resins in an amount, which varies depending on the desired properties of the curable compositions that make up the abrasive layer of the abrasive article of the various embodiments described herein. In some embodiments, the curable compositions comprise one or more epoxy resins in an amount of at least 20, at least 25, at least 35, at least 40, at least 50 parts, or at least 55 parts by weight, based on the 100 parts total weight of the composition. In some embodiments, the one or more epoxy resins are present in an amount of at most 45, at most 50 parts, at most 75 parts, or at most 80 parts by weight, based on the 100 parts total weight of the monomers/copolymers in the curable compositions.

Vinyl ethers represent a different class of monomers that, like epoxy resins, are cationic polymerizable. These monomers can be used as an alternative to, or in combination with, the epoxy resins disclosed herein.

While not wishing to be bound by any specific theory, it is believed that the vinyl ether monomer has a high electron density of double bonds and produces a stable carbocation, enabling this monomer to have high reactivity in cationic polymerizations. To avoid inhibiting the cationic polymerization, the vinyl ether monomer may be limited to those not containing nitrogen. Examples thereof include methyl vinyl ether, ethyl vinyl ether, tert-butyl vinyl ether, isobutyl vinyl ether, triethylene glycol divinyl ether, and 1,4-cyclohexane dimethanol divinyl ether. Preferred examples of the vinyl ether monomer include triethylene glycol divinyl ether and cyclohexane dimethanol divinyl ether (both sold under the trade designation RAPI-CURE by Ashland, Inc., Covington, Kentucky).

The curable compositions can further include one or more hydroxy-functional polyether. In some embodiments, the one or more hydroxy-functional polyether is a liquid at a temperature of 25° C. and pressure of 1 atm (101 kilopascals). In some embodiments, the one or more hydroxy-functional polyethers include a polyether polyol. The polyether polyol can be present in an amount of at least 5 parts, at least 10 parts, or at most 15 parts relative to 100 parts total weight of monomers/copolymers in the composition. In some embodiments, the polyether polyol is present in an amount of at most 15 parts, at most 20 parts, or at most 30 parts relative to 100 parts total weight of monomers/copolymers in the composition.

Examples of hydroxy-functional polyethers include, but are not limited to, polyoxyethylene and polyoxypropylene glycols; polyoxyethylene and polyoxypropylene triols and polytetramethylene oxide glycols.

Suitable hydroxy-functional poly(alkylenoxy) compounds include, but are not limited to, the POLYMEG™ series of polytetramethylene oxide glycols (from Lyondellbasell, Inc., Jackson, TN), the TERATHANE™ series of polytetramethylene oxide glycols (from Invista, Newark, DE); the POLYTHF™ series of polytetramethylene oxide glycol (from BASF SE, Ludwigshafen, Germany); the ARCOL™ series of polyoxypropylene polyols (from Bayer MaterialScience LLC, Pittsburgh, PA) and the VORANOL™ series of polyether polyols (from Dow Chemical Company, Midland, MI).

The curable compositions of the various embodiments described herein, that are used to form the abrasive layer can further contain at least one polyhydroxyl-functional compound having at least one and, in some instances, at least two hydroxyl groups. As used herein, the term "polyhydroxyl-functional compound" does not include the polyether polyols described herein, which also contain hydroxyl groups. In some embodiments, the polyhydroxyl-functional compounds are substantially free of other "active hydrogen" containing groups such as amino and mercapto moieties. Further, the polyhydroxyl-functional compounds can also be substantially free of groups, which may be thermally and/or photolytically unstable so that the compounds will not decompose when exposed to UV radiation and, in some instances, heat during curing.

The polyhydroxyl-functional compound contains, in some instances, two or more primary or secondary aliphatic hydroxyl groups (i.e., the hydroxyl group is bonded directly to a non-aromatic carbon atom). In some embodiments, the polyhydroxyl-functional compound has a hydroxyl number of at least 0.01. While not wishing to be bound by any specific theory, it is believed the hydroxyl groups participate in the cationic polymerization with the epoxy resin.

The polyhydroxyl-functional compound may be selected from phenoxy resins, ethylene-vinyl acetate ("EVA") copolymers, polycaprolactone polyols, polyester polyols, and polyvinyl acetal resins that are solid under ambient conditions. In some embodiments, the polyhydroxyl-functional compound is solid at a temperature of 25° C. and pressure of 1 atm (101 kilopascals). The hydroxyl group may be terminally situated, or may be pendent from a polymer or copolymer. In some embodiments, the addition of a polyhydroxyl-functional compound to the curable compositions of the various embodiments described herein can improve the dynamic overlap shear strength and/or decrease the cold flow of the curable compositions used to make the abrasive layer.

One useful class of polyhydroxyl-functional compound is hydroxy-containing phenoxy resins. Desirable phenoxy resins include those derived from the polymerization of a diglycidyl bisphenol compound. Typically, the phenoxy resin has a number average molecular weight of less than 60,000 g/mol (e.g., in the range of 20,000 g/mol to 30,000 g/mol). Commercially available phenoxy resins include, but are not limited to, PAPHEN™ PKHP-200, available from Inchem Corp., Rock Hill, SC and the SYN FAC™ series of polyoxyalkylated bisphenol A from Milliken Chemical, Spartanburg, SC) such as SYN FAC™ 8009, 8024, 8027, 8026, and 8031.

Another useful class of polyhydroxyl-functional compound is that of EVA copolymer resins. While not wishing to be bound by any specific theory, it is believed that these resins contain small amounts of free hydroxyl groups, and that EVA copolymers are further deacetylated during cationic polymerization. Hydroxyl-containing EVA resins can be obtained, for example, by partially hydrolyzing a precursor EVA copolymer.

Suitable ethylene-vinyl acetate copolymer resins include, but are not limited to, thermoplastic EVA copolymer resins containing at least 28 percent by weight vinyl acetate. In one embodiment, the EVA copolymer comprises a thermoplastic copolymer containing at least 28 percent by weight vinyl acetate, desirably at least 40 percent by weight vinyl acetate (e.g., at least 50 percent by weight vinyl acetate and at least 60 percent by weight vinyl acetate) by weight of the copolymer. In a further embodiment, the EVA copolymer contains an amount of vinyl acetate in the range of from 28 to 99 weight percent of vinyl acetate (e.g., from 40 to 90 weight percent of vinyl acetate; from 50 to 90 weight percent of vinyl acetate; and from 60 to 80 weight percent vinyl acetate) in the copolymer.

Examples of commercially available EVA copolymers include, but are not limited to, the ELVAX™ series, including ELVAX™ 150, 210, 250, 260, and 265 from E. I. Du Pont de Nemours and Co., Wilmington, DE, ATEVA™ series from Celanese, Inc., Irving, TX); LEVAPREN™ 400 from Bayer Corp., Pittsburgh, PA including LEVAPREN™ 450, 452, and 456 (45 weight percent vinyl acetate); LEVAPREN™ 500 HV (50 weight percent vinyl acetate); LEVAPREN™ 600 HV (60 weight percent vinyl acetate); LEVAPREN™ 700 HV (70 weight percent vinyl acetate); and LEVAPREN™ KA 8479 (80 weight percent vinyl acetate), each from Lanxess Corp., Cologne, Germany.

Additional useful polyhydroxyl-functional compounds include the TONE™ series of polycaprolactone polyols series available from Dow Chemical, the CAPA™ series of polycaprolactone polyols from Perstorp Inc., Perstorp, Sweden, and the DESMOPHEN™ series of saturated polyester polyols from Bayer Corporation, Pittsburgh, PA, such as DESMOPHEN™ 631A 75.

The curable composition comprises at least one polyhydroxyl-functional compound in an amount, which can vary depending on the desired properties of the curable composition, whether cured or uncured. The curable composition can include at least one polyhydroxyl-functional compound in an amount of at least 10 parts, at least 15 parts, at least 20 parts, or at least 25 parts by weight, based on 100 parts total weight of monomers/copolymers in the composition. In some embodiments, the at least one polyhydroxyl-functional compound can be present in an amount of at most 20 parts, at most 25 parts, or at most 50 parts, based on 100 parts total weight of monomers/copolymers in the composition.

Useful photoinitiators for use in the curable compositions of the various embodiments described herein include photoinitiators used to i) polymerize precursor polymers (for example, in some embodiments, tetrahydrofurfuryl (meth) acrylate copolymer) and ii) those used to ultimately polymerize the curable compositions.

Photoinitiators for the former include benzoin ethers such as benzoin methyl ether and benzoin isopropyl ether; substituted acetophenones such as 2,2 dimethoxy-1,2-diphenylethanone, available as IRGACURE™ 651 (BASF SE) or ESACURE™ KB-1 (Sartomer Co., West Chester, PA), di methoxyhydroxyacetophenone; substituted α-ketols such as 2-methyl-2-hydroxy propiophenone; aromatic sulfonyl chlorides such as 2-naphthalene-sulfonyl chloride; and photoactive oximes such as 1-phenyl-1,2-propanedione-2-(O-ethoxy-carbonyl)oxime. In some specific embodiments, the photoinitiators are substituted acetophenones.

In some embodiments, photoinitiators are photoactive compounds that undergo a Norrish I cleavage to generate free radicals that can initiate by addition to the acrylic double bonds. In some embodiments, such photoinitiators are present in an amount of from 0.1 to 1.0 pbw per 100 parts of the precursor polymer composition. Examples of such photoinitiators include, but are not limited to, ionic photoacid generators, which are compounds that can generate acids upon exposure to actinic radiation. These are extensively used to initiate cationic polymerizations, in which case they are referred to as cationic photoinitiators.

Useful ionic photoacid generators include bis(4-t-butylphenyl) iodonium hexafluoroantimonate (FP5034™ from Hampford Research Inc., Stratford, CT), a mixture of triarylsulfonium salts (diphenyl(4-phenylthio) phenylsufonium hexafluoroantimonate, bis(4-(diphenylsulfonio)phenyl)sulfide hexafluoroantimonate) available as Syna PI-6976™ from Synasia Metuchen, NJ, (4-methoxyphenyl) phenyl iodonium triflate, bis(4-fert-butylphenyl) iodonium camphorsulfonate, bis(4-tert-butylphenyl) iodonium hexafluoroantimonate, bis(4-tert-butylphenyl) iodonium hexafluorophosphate, bis(4-tert-butylphenyl) iodonium tetraphenylborate, bis(4-tert-butylphenyl) iodonium tosylate, bis(4-tert-butylphenyl) iodonium triflate, ([4-(octyloxy)phenyl]phenyliodonium hexafluorophosphate), ([4-(octyloxy) phenyl]phenyliodonium hexafluoroantimonate), (4-isopropylphenyl)(4-methylphenyl)iodonium tetrakis (pentafluorophenyl) borate (available as Rhodorsil 2074™ from Bluestar Silicones, East Brunswick, NJ), bis(4-methylphenyl) iodonium hexafluorophosphate (available as Omnicat 440™ from IGM Resins Bartlett, IL), 4-(2-hydroxy-1-tetradecycloxy)phenyl]phenyl iodonium hexafluoroantimonate, triphenyl sulfonium hexafluoroantimonate (available as CT-548™ from Chitec Technology Corp. Taipei, Taiwan), diphenyl(4-phenylthio)phenylsufonium hexafluorophosphate, bis(4-(diphenylsulfonio)phenyl)sulfide bis(hexafluorophosphate), diphenyl(4-phenylthio)phenylsufonium hexafluoroantimonate, bis(4-(diphenylsulfonio)phenyl)sulfide hexafluoroantimonate, and blends of these triarylsulfonium salts available from Synasia, Metuchen, NJ as SYNA™ PI-6992 and SYNA™ PI-6976 for the PF6 and SbF6 salts, respectively. Similar blends of ionic photoacid generators are available from Aceto Pharma Corporation, Port Washington, NY as UVI-6992 and UVI-6976.

The photoinitiator is used in amounts sufficient to effect the desired degree of crosslinking of the copolymer. The desired degree of crosslinking may vary, depending on the desired properties of the abrasive layer (whether cured or uncured) or the thickness of the abrasive layer (whether cured or uncured). The amount of the photoinitiator necessary to effect the desired degree of crosslinking will depend on the quantum yield of the photoinitiator (the number of molecules of acid released per photon absorbed), the permeability of the polymer matrix, the wavelength and duration of irradiation and the temperature. Generally the photoinitiator is used in amounts of at least 0.001 parts, at least 0.005 parts, at least 0.01 parts, at least 0.05 parts, at least 0.1 parts, or at least 0.5 parts by weight relative to 100 parts by weight of total monomer/copolymer in the composition. The photoinitiator is generally used in amounts of at most 5 parts, at most 3 parts, at most 1 part, at most 0.5 parts, at most 0.3 parts, or at most 0.1 parts by weight relative to 100 parts by weight of total monomer/copolymer in the composition.

The curable compositions of the various embodiments described herein may further contain any of a number of optional additives. Such additives may be homogeneous or heterogeneous with one or more components in the composition. Heterogenous additives may be discrete (e.g., particulate) or continuous in nature.

Aforementioned additives can include, for example, fillers, stabilizers, plasticizers, tackifiers, flow control agents, cure rate retarders, adhesion promoters (for example, silanes such as (3-glycidoxypropyl)trimethoxysilane (GPTMS), and titanates), adjuvants, impact modifiers, expandable microspheres, thermally conductive particles, electrically conductive particles, and the like, such as silica, glass, clay, talc, pigments, colorants, glass beads or bubbles, and antioxidants, so as to reduce the weight and/or cost of the structural layer composition, adjust viscosity, and/or provide additional reinforcement or modify the thermal conductivity of compositions and articles used in the provided methods so that a more rapid or uniform cure may be achieved.

In some embodiments, the curable compositions can contain one or more fiber reinforcement materials. The use of a fiber reinforcement material can provide an abrasive layer having improved cold flow properties, limited stretchability, and enhanced strength. Preferably, the one or more fiber reinforcement materials have a certain degree of porosity that enables the photoinitiator, which can be dispersed throughout the, to be activated by UV light and properly cured without the need for heat.

The one or more fiber reinforcements may comprise one or more fiber-containing webs including, but not limited to, woven fabrics, nonwoven fabrics, knitted fabrics, and a unidirectional array of fibers. The one or more fiber reinforcements could comprise a nonwoven fabric, such as a scrim.

Materials for making the one or more fiber reinforcements may include any fiber-forming material capable of being formed into one of the above-described webs. Suitable fiber-forming materials include, but are not limited to, polymeric materials such as polyesters, polyolefins, and aramids; organic materials such as wood pulp and cotton; inorganic materials such as glass, carbon, and ceramic; coated fibers having a core component (e.g., any of the above fibers) and a coating thereon; and combinations thereof.

Further options and advantages of the fiber reinforcement materials are described in U.S. Patent Publication No. 2002/0182955 (Weglewski et al.).

As discussed herein, the polymerizable composition used to form the THFA copolymer component, the curable compositions used to form the abrasive layer, and/or the compositions used to make the size coat may be irradiated using various activating UV light sources to polymerize (e.g., photopolymerize) one or more component(s).

Light sources based on light emitting diodes can enable a number of advantages. These light sources can be monochromatic, which for the purposes of this disclosure implies that the spectral power distribution is characterized by a very narrow wavelength distribution (e.g., confined within a 50 nm range or less). Monochromatic ultraviolet light can reduce thermal damage or harmful deep UV effects to coatings and substrates being irradiated. In larger scale applications, the lower power consumption of UV-LED sources can also allow for energy savings and reduced environmental impact.

In some embodiments, matching the spectral power distribution of the photoinitiator with the absorption spectrum of UV light source too closely can result in inferior curing of thick abrasive layers. While not wishing to be bound by any specific theory, it is believed that aligning the peak output of the UV source with the excitation wavelength of the photoinitiator can be undesirable because it leads to formation of a "skin" layer that dramatically increases the viscosity of the monomer mixture and progressively hinders the ability of available monomer to access reactive polymer chain ends. The result of this lack of access is a layer of uncured, or only partially cured, abrasive layer beneath the skin layer and subsequent failure of the abrasive layer to, e.g., retain abrasive particles.

This technical problem can be alleviated by using a UV light source with a spectral power distribution that is offset from the primary excitation wavelength at which the photoinitiator is activated. As used herein, "offset" between the spectral power distribution and a given wavelength means that the given wavelength does not overlap with wavelengths over which the output of the UV light source has significant intensity. In one embodiment, the offset referred to above is a positive offset (e.g., the spectral power distribution spans wavelengths that are higher than the primary excitation wavelength of the photoinitiator).

In this disclosure, the primary excitation wavelength can be defined at the highest wavelength absorption peak (e.g., the local maximum absorption peak located at the highest wavelength) in the UV absorption curve of the photoinitiator, as determined by spectroscopic measurement at a photoinitiator concentration of 0.03 wt % in acetonitrile solution.

In some embodiments, the highest wavelength absorption peak is located at a wavelength of at most 395 nm, at most 375 nm, or at most 360 nm.

In some embodiments, the difference in wavelength between the highest wavelength absorption peak of the photoinitiator and the peak intensity of the UV light source is in the range of from 30 nm to 110 nm, preferably from 40 nm to 90 nm, and more preferably from 60 nm to 80 nm.

The UV radiation exposure time required to obtain sufficient activation of the photoinitiator(s) is not particularly restricted. In some embodiments, the curable composition is exposed to ultraviolet radiation over an exposure period of at least 0.25 seconds, at least 0.35 seconds, at least 0.5 seconds, or at least 1 second. The curable composition can be exposed to ultraviolet radiation over an exposure period of at most 10 minutes, at most 5 minutes, at most 2 minutes, at most 1 minute, or at most 20 seconds.

Based on the exposure time used, the UV radiation should provide a sufficient energy density to obtain a functional cure. In some embodiments, the UV radiation can deliver an energy density of at least 0.5 J/cm$^2$, at least 0.75 J/cm$^2$, or at least 1 J/cm$^2$. In the same or alternative embodiments, the UV radiation can deliver an energy density of at most 15 J/cm$^2$, at most 12 J/cm$^2$, or at most 10 J/cm$^2$.

The abrasive article of the various embodiments described herein include an abrasive layer, such as any of abrasive layers 100, 200, and 300. The abrasive layer is a layer containing a hard mineral that serves to abrade a workpiece. In FIGS. 1-3, the abrasive layer is a coated abrasive film that includes a plurality of abrasive particles 107 secured to an abrasive layer of the various embodiments described herein. The abrasive particles 107 are adhesively coupled to the optional backing by implementing a sequence of coating operations involving the abrasive layer 102 and size coat 202. As mentioned herein, the abrasive layer results from the curing of the curable composition.

In the configuration shown in FIGS. 1-3, the abrasive particles 107 are at least partially embedded in at least the abrasive layer 102 in close proximity to the surface of the abrasive article 100. This allows the abrasive particles 107 to easily come into frictional contact with the workpiece when the abrasive article 100 is rubbed against the workpiece.

A wide variety of abrasive particles may be utilized in the various embodiments described herein. The particular type of abrasive particle (e.g. size, shape, chemical composition) is not considered to be particularly significant to the abrasive article, so long as at least a portion of the abrasive particles are suitable for the intended end-use application. Suitable abrasive particles may be formed of, for example, cubic boron nitride, zirconia, alumina, silicon carbide and diamond.

The abrasive particles may be provided in a variety of sizes, shapes and profiles, including, for example, random or crushed shapes, regular (e.g. symmetric) profiles such as square, star-shaped or hexagonal profiles, and irregular (e.g. asymmetric) profiles.

The abrasive article may include a mixture of abrasive particles that are inclined on the backing (i.e. stand upright and extend outwardly from the backing) as well as abrasive particles that lie flat on their side (i.e. they do not stand upright and extend outwardly from the backing).

The abrasive article may include a mixture of different types of abrasive particles. For example, the abrasive article may include mixtures of platey and non-platey particles, crushed and shaped particles (which may be discrete abrasive particles that do not contain a binder or agglomerate abrasive particles that contain a binder), conventional non-shaped and non-platey abrasive particles (e.g. filler material) and abrasive particles of different sizes.

Examples of suitable shaped abrasive particles can be found in, for example, U.S. Pat. No. 5,201,916 (Berg) and U.S. Pat. No. 8,142,531 (Adefris et al.) A material from which the shaped abrasive particles may be formed comprises alpha alumina. Alpha alumina shaped abrasive particles can be made from a dispersion of aluminum oxide monohydrate that is gelled, molded to shape, dried to retain the shape, calcined, and sintered according to techniques known in the art.

U.S. Pat. No. 8,034,137 (Erickson et al.) describes alumina abrasive particles that have been formed in a specific shape, then crushed to form shards that retain a portion of their original shape features. In some embodiments, shaped alpha alumina particles are precisely-shaped (i.e., the particles have shapes that are at least partially determined by the shapes of cavities in a production tool used to make them). Details concerning such shaped abrasive particles and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U.S. Pat. Appl. Publ. Nos. 2012/0227333 (Adefris et al.); 2013/0040537 (Schwabel et al.); and 2013/0125477 (Adefris).

Examples of suitable crushed abrasive particles include crushed abrasive particles comprising fused aluminum oxide, heat-treated aluminum oxide, white fused aluminum oxide, ceramic aluminum oxide materials such as those commercially available as 3M CERAMIC ABRASIVE GRAIN from 3M Company, St. Paul, Minnesota, brown aluminum oxide, blue aluminum oxide, silicon carbide (including green silicon carbide), titanium diboride, boron carbide, tungsten carbide, garnet, titanium carbide, diamond, cubic boron nitride, garnet, fused alumina zirconia, iron oxide, chromia, zirconia, titania, tin oxide, quartz, feldspar, flint, emery, sol-gel-derived ceramic (e.g., alpha alumina), and combinations thereof. Further examples include crushed abrasive composites of abrasive particles (which may be platey or not) in a binder matrix, such as those described in U.S. Pat. No. 5,152,917 (Pieper et al.).

Examples of sol-gel-derived abrasive particles from which crushed abrasive particles can be isolated, and methods for their preparation can be found in U.S. Pat. No. 4,314,827 (Leitheiser et al.); U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.). It is also contemplated that the crushed abrasive particles could comprise abrasive agglomerates such as, for example, those described in U.S. Pat. No. 4,652,275 (Bloecher et al.) or U.S. Pat. No. 4,799,939 (Bloecher et al.).

The crushed abrasive particles comprise ceramic crushed abrasive particles such as, for example, sol-gel-derived polycrystalline alpha alumina particles. Ceramic crushed abrasive particles composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Publ. Pat. Appln. Nos. 2009/0165394 A1 (Culler et al.) and 2009/0169816 A1 (Erickson et al.).

Further details concerning methods of making sol-gel-derived abrasive particles can be found in, for example, U.S. Pat. No. 4,314,827 (Leitheiser); U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and in U.S. Patent Publication No. 2009/0165394 A1 (Culler et al.). Examples of suitable platey crushed abrasive particles can be found in, for example, U.S. Pat. No. 4,848,041 (Kruschke).

The abrasive particles may be surface-treated with a coupling agent (e.g., an organosilane coupling agent) or other physical treatment (e.g., iron oxide or titanium oxide) to enhance adhesion of the crushed abrasive particles to the binder.

The abrasive layer, in some embodiments, includes a particulate mixture comprising a plurality of formed abrasive particles (e.g., precision shaped grain (PSG) mineral particles available from 3M, St. Paul, MN, which are described in greater detail herein; not shown in FIGS. 1-3) and a plurality of abrasive particles 107, or only formed abrasive particles, adhesively secured to the abrasive layer.

In some embodiment, the abrasive particles may be formed abrasive particles. As used herein, the term "formed abrasive particles" generally refers to abrasive particles (e.g., formed ceramic abrasive particles) having at least a partially replicated shape. Non-limiting examples of formed abrasive particles are disclosed in Published U.S. Patent Appl. No. 2013/0344786, which is incorporated by reference as if fully set forth herein. Non-limiting examples of formed abrasive particles include shaped abrasive particles formed in a mold, such as triangular plates as disclosed in U.S. Pat. Nos. RE 35,570; 5,201,916, and 5,984,998 all of which are incorporated by reference as if fully set forth herein; or extruded elongated ceramic rods/filaments often having a circular cross section produced by Saint-Gobain Abrasives an example of which is disclosed in U.S. Pat. No. 5,372,620, which is incorporated by reference as if fully set forth herein. Formed abrasive particle as used herein excludes randomly sized abrasive particles obtained by a mechanical crushing operation.

Formed abrasive particles also include shaped abrasive particles. As used herein, the term "shaped abrasive particle," generally refers to abrasive particles with at least a portion of the abrasive particles having a predetermined shape that is replicated from a mold cavity used to form the shaped precursor abrasive particle. Except in the case of abrasive shards (e.g. as described in U.S. patent publication US 2009/0169816), the shaped abrasive particle will generally have a predetermined geometric shape that substantially replicates the mold cavity that was used to form the shaped abrasive particle. Shaped abrasive particle as used herein excludes randomly sized abrasive particles obtained by a mechanical crushing operation.

Formed abrasive particles also include precision-shaped grain (PSG) mineral particles, such as those described in Published U.S. Appl. No. 2015/267097, which is incorporated by reference as if fully set forth herein.

Examples of suitable abrasive particles include, for example, fused aluminum oxide, heat treated aluminum oxide, white fused aluminum oxide, black silicon carbide, green silicon carbide, titanium diboride, boron carbide, silicon nitride, tungsten carbide, titanium carbide, diamond, cubic boron nitride, hexagonal boron nitride, garnet, fused alumina zirconia, alumina-based sol gel derived abrasive particles, silica, iron oxide, chromia, ceria, zirconia, titania, tin oxide, gamma alumina, and mixtures thereof. The alumina abrasive particles may contain a metal oxide modifier. The diamond and cubic boron nitride abrasive particles may be monocrystalline or polycrystalline.

In some examples, the formed abrasive particles have a substantially monodisperse particle size of from about 1 micrometers to about 5000 micrometers, from about 1 micrometers to about 2500, from about 1 micrometers to about 1000, from about 10 micrometers to about 5000, from about 10 micrometers to about 2500, from about 10 micrometers to about 1000, from about 50 micrometers to about 5000, from about 50 micrometers to about 2500, from about 50 micrometers to about 1000. As used herein, the term "substantially monodisperse particle size" is used to describe formed abrasive particles having a size that does not vary substantially. Thus, for example, when referring to formed abrasive particles (e.g., a PSG mineral particles) having a particle size of 100 micrometers, greater than 90%, greater than 95% or greater than 99% of the formed abrasive particles will have a particle having its largest dimension be 100 micrometers.

In some embodiments, the abrasive particles can have a range or distribution of particle sizes. Such a distribution can be characterized by its median particle size. For instance, the median particle size of the abrasive particles may be at least 0.001 micrometers, at least 0.005 micrometers, at least 0.01 micrometers, at least 0.015 micrometers, or at least 0.02 micrometers. In some instances, the median particle size of the abrasive particles may be up to 300 micrometers, up to 275 micrometers, up to 250 micrometers, up to 150 micrometers, or up to 100 micrometers. In some examples, the median particle size of the abrasive particles is from about 1 micrometers to about 600 micrometers, from about 1 micrometers to about 300 micrometers, from about 1 micrometers to about 150 micrometers, from about 10 micrometers to about 600 micrometers, from about 10 micrometers to about 300 micrometers, from about 10 micrometers to about 150 micrometers, from about 50 micrometers to about 600 micrometers, from about 50 micrometers to about 300 micrometers, from about 50 micrometers to about 150 micrometers.

In some examples, the abrasive particle of the present disclosure may include formed abrasive particles. The formed abrasive particles may be present from 0.01 wt. percent to 100 wt, percent, from 0.1 wt. percent to 100 wt, percent, from 1 wt. percent to 100 wt, from 10 wt. percent to 100 wt, percent, from 0.01 wt. percent to 90 wt, percent, from 0.1 wt. percent to 90 wt, percent, from 1 wt. percent to 90 wt, from 10 wt. percent to 90 wt, percent, from 0.01 wt. percent to 75 wt, percent, from 0.1 wt. percent to 75 wt, percent, from 1 wt. percent to 75 wt, from 10 wt. percent to 75 wt, percent, based on the total weight of the abrasive particles.

In some examples, the particulate mixture comprises from about greater than 90 wt. % to about 99 wt. % abrasive particles (e.g., from about 91 wt. % to about 97 wt. %; about 92 wt. % to about 97 wt. %; about 95 wt. % to about 97 wt. %; or greater than about 90 wt. % to about 97 wt. %).

In some embodiments, the abrasive article of the various embodiments described herein include a size coat. In some examples, the size coat comprises the cured (e.g., photopolymerized) product of a bis-epoxide (e.g., 3,4-epoxy cyclohexylmethyl-3,4-epoxy cyclohexylcarboxylate, available from Daicel Chemical Industries, Ltd., Tokyo, Japan); a trifunctional acrylate (e.g., trimethylol propane triacrylate, available under the trade designation "SR351" from Sartomer USA, LLC, Exton, PA); an acidic polyester dispersing agent (e.g., "BYK W-985" from Byk-Chemie, GmbH, Wesel, Germany); a filler (e.g., a sodium-potassium alumina silicate filler, obtained under the trade designation "MINEX 10" from The Cary Company, Addison, IL.); a photoinitiator (e.g., a triarylsulfonium hexafluoroantimonate/propylene carbonate photoinitiator, obtained under the trade designation "CYRACURE CPI 6976" from Dow Chemical Company, Midland, MI; and an α-Hydroxyketone photoinitiator, obtained under the trade designation "DAROCUR 1173" from BASF Corporation, Florham Park, NJ).

The abrasive article of the various embodiments described herein optionally include a backing, e.g. backing 302. The backing may be constructed from any of a number of materials known in the art for making coated abrasive articles. Although not necessarily so limited, the backing can have a thickness of at least 0.02 millimeters, at least 0.03 millimeters, 0.05 millimeters, 0.07 millimeters, or 0.1 millimeters. The backing could have a thickness of up to 5 millimeters, up to 4 millimeters, up to 2.5 millimeters, up to 1.5 millimeters, or up to 0.4 millimeters.

In some examples, the backing is flexible and may be either solid porous. Flexible backing materials include polymeric film (including primed films) such as polyolefin film (e.g., polypropylene including biaxially oriented polypropylene), polyester film, polyamide film, cellulose ester film, polyurethane rubber, metal foil, mesh, polymeric foam (e.g., natural sponge material or polyurethane foam), cloth (e.g., cloth made from fibers or yarns comprising polyester, nylon, silk, cotton, and/or rayon), scrim, paper, coated paper, vulcanized paper, vulcanized fiber, nonwoven materials, combinations thereof, and treated versions thereof. The backing may also be a laminate of two materials (e.g., paper/film, cloth/paper, film/cloth). Cloth backings may be woven, knit or stitch bonded. In some examples, the backing is a thin and conformable polymeric film capable of expanding and contracting in transverse (i.e. in-plane) directions during use. Liners of the present disclosure may include flexible backing materials described above.

Useful backing materials can be highly conformable. Highly conformable polymers that may be used in the backing include certain polyolefin copolymers, polyurethanes, and polyvinyl chloride. An example of a polyolefin copolymer is an ethylene-acrylic acid resin (available under the trade designation "PRIMACOR 3440" from Dow Chemical Company, Midland, MI). Optionally, ethylene-acrylic acid resin is one layer of a bilayer film in which the other layer is a polyethylene terephthalate ("PET") carrier film. In this example, the PET film is not part of the backing itself and is stripped off prior to using the abrasive article 100. While it is possible to strip the PET from the ethylene-acrylic acid resin surface, the ethylene-acrylic acid resin and the PET can also be bonded such that these two layers stay together during use of the abrasive article.

Optionally, the backing may have at least one of a saturant, presize layer, or backsize layer. These materials can be used to seal the backing or to protect yarn or fibers present in the backing. If the backing is a cloth material, at least one of these materials is typically used. Advantageously, the addition of the presize layer or backsize layer can provide a smoother surface on either the front and/or the back side of the backing. Other optional layers known in the art may also be used, as described in U.S. Pat. No. 5,700,302 (Stoetzel et al.), which is incorporated by reference as if fully set forth herein.

The abrasive article of the various embodiments described include a supersize coat, e.g. 204. In general, the supersize coat is the outermost coating of the abrasive article and directly contacts the workpiece during an abrading operation. The supersize coat is, in some examples, substantially transparent.

The term "substantially transparent" as used herein refers to a majority of, or mostly, as in at least about 30%, 40%, 50%, 60%, or at least about 70% or more transparent. In some examples, the measure of the transparency of any given coat described herein (e.g., the supersize coat) is the coat's transmittance. In some examples, the supersize coat displays a transmittance of at least 5 percent, at least 20 percent, at least 40 percent, at least 50 percent, or at least 60 percent (e.g., a transmittance from about 40 percent to about 80 percent; about 50 percent to about 70 percent; about 40 percent to about 70 percent; or about 50 percent to about 70 percent), according to a Transmittance Test that measures the transmittance of 500 nm light through a sample of 6 by 12 inch by approximately 1-2 mil (15.24 by 30.48 cm by 25.4-50.8 μm) clear polyester film, having a transmittance of about 98%.

One component of supersize coats can be a metal salt of a long-chain fatty acid (e.g., a $C_{12}$-$C_{22}$ fatty acid, a $C_{14}$-$C_{18}$ fatty acid, and a $C_{16}$-$C_{20}$ fatty acid). In some examples, the metal salt of a long-chain fatty acid is a stearate salt (e.g., a salt of stearic acid). The conjugate base of stearic acid is $C_{17}H_{35}COO$—, also known as the stearate anion. Useful stearates include, but are not limited to, calcium stearate, zinc stearate, and combinations thereof.

The metal salt of a long-chain fatty acid can be present in an amount of at least 10 percent, at least 50 percent, at least 70 percent, at least 80 percent, or at least 90 percent by weight based on the normalized weight of the supersize coat (i.e., the average weight for a unit surface area of the abrasive article). The metal salt of a long-chain fatty acid can be present in an amount of up to 100 percent, up to 99 percent, up to 98 percent, up to 97 percent, up to 95 percent, up to 90 percent, up to 80 percent, or up to 60 percent by weight (e.g., from about 10 wt. % to about 100 wt. %; about 30 wt. % to about 70 wt. %; about 50 wt. % to about 90 wt. %; or about 50 wt. % to about 100 wt. %) based on the normalized weight of the supersize coat.

Another component of the supersize coat is a polymeric binder, which, in some examples, enables the supersize coat to form a smooth and continuous film over the abrasive layer. In one example, the polymeric binder is a styrene-acrylic polymer binder. In some examples, the styrene-acrylic polymer binder is the ammonium salt of a modified styrene-acrylic polymer, such as, but not limited to, JONCRYL® LMV 7051. The ammonium salt of a styrene-acrylic polymer can have, for example, a weight average molecular weight (Mw) of at least 100,000 g/mol, at least 150,000 g/mol, at least 200,000 g/mol, or at least 250,000 g/mol (e.g., from about 100,000 g/mol to about 2.5×106 g/mol; about 100,000 g/mol to about 500,000 g/mol; or about 250,000 to about 2.5×106 g/mol).

The minimum film-forming temperature, also referred to as MFFT, is the lowest temperature at which a polymer self-coalesces in a semi-dry state to form a continuous polymer film. In the context of the present disclosure, this polymer film can then function as a binder for the remaining solids present in the supersize coat. In some examples, the styrene-acrylic polymer binder (e.g., the ammonium salt of a styrene-acrylic polymer) has an MFFT that is up to 90° C., up to 80° C., up to 70° C., up to 65° C., or up to 60° C.

In some examples, the binder is dried at relatively low temperatures (e.g., at 70° C. or less). The drying temperatures are, in some examples, below the melting temperature of the metal salt of a long-chain fatty acid component of the supersize coat. Use of excessively high temperatures (e.g., temperatures above 80° C.) to dry the supersize coat is undesirable because it can induce brittleness and cracking in the backing, complicate web handling, and increase manufacturing costs. By virtue of its low MFFT, a binder comprised of, e.g., the ammonium salt of a styrene-acrylic polymer allows the supersize coat to achieve better film formation at lower binder levels and at lower temperatures without need for added surfactants such as DOWANOL® DPnP.

The polymeric binder can be present in an amount of at least 0.1 percent, at least 1 percent, or at least 3 percent by weight, based on the normalized weight of the supersize coat. The polymeric binder can be present in an amount of up to 20 percent, up to 12 percent, up to 10 percent, or up to 8 percent by weight, based on the normalized weight of the supersize coat. Advantageously, when the ammonium salt of a modified styrene acrylic copolymer is used as a binder, the haziness normally associated with a stearate coating is substantially reduced.

The supersize coats of the present disclosure optionally contain clay particles dispersed in the supersize coat. The clay particles, when present, can be uniformly mixed with the metal salt of a long chain fatty acid, polymeric binder, and other components of the supersize composition. The clay can bestow unique advantageous properties to the abrasive article, such as improved optical clarity and improved cut performance. The inclusion of clay particles can also enable cut performance to be sustained for longer periods of time relative to supersize coats in which the clay additive is absent.

The clay particles, when present, can be present in an amount of at least 0.01 percent, at least 0.05 percent, at least 0.1 percent, at least 0.15 percent, or at least 0.2 percent by weight based on the normalized weight of the supersize coat. Further, the clay particles can be present in an amount of up to 99 percent, up to 50 percent, up to 25 percent, up to 10 percent, or up to 5 percent by weight based on the normalized weight of the supersize coat.

The clay particles may include particles of any known clay material. Such clay materials include those in the geological classes of the smectites, kaolins, illites, chlorites, serpentines, attapulgites, palygorskites, vermiculites, glauconites, sepiolites, and mixed layer clays. Smectites in particular include montmorillonite (e.g., a sodium montmorillonite or calcium montmorillonite), bentonite, pyrophyllite, hectorite, saponite, sauconite, nontronite, talc, beidellite, and volchonskoite. Specific kaolins include kaolinite, dickite, nacrite, antigorite, anauxite, halloysite, indellite and chrysotile. Illites include bravaisite, muscovite, paragonite, phlogopite and biotite. Chlorites can include, for example, corrensite, penninite, donbassite, sudoite, pennine and clinochlore. Mixed layer clays can include allevardite and vermiculitebiotite. Variants and isomorphic substitutions of these layered clays may also be used.

As an optional additive, abrasive performance may be further enhanced by nanoparticles (i.e., nanoscale particles) interdispersed (e.g., in the clay particles) in the supersize coat. Useful nanoparticles include, for example, nanoparticles of metal oxides, such as zirconia, titania, silica, ceria, alumina, iron oxide, vanadia, zinc oxide, antimony oxide, tin oxide, and alumina-silica. The nanoparticles can have a median particle size of at least 1 nanometer, at least 1.5 nanometers, or at least 2 nanometers. The median particle size can be up to 200 nanometers, up to 150 nanometers, up to 100 nanometers, up to 50 nanometers, or up to 30 nanometers.

Other optional components of the supersize composition include curing agents, surfactants, antifoaming agents, biocides, and other particulate additives known in the art for use in supersize compositions.

The supersize coat can be formed, in some examples, by providing a supersize composition in which the components are dissolved or otherwise dispersed in a common solvent. In some examples, the solvent is water. After being suitably mixed, the supersize dispersion can be coated onto the underlying layers of the abrasive article and dried to provide the finished supersize coat. If a curing agent is present, the supersize composition can be cured (e.g., hardened) either thermally or by exposure to actinic radiation at suitable wavelengths to activate the curing agent.

The coating of the supersize composition onto, e.g., the abrasive layer can be carried out using any known process. In some examples, the supersize composition is applied by spray coating at a constant pressure to achieve a predetermined coating weight. Alternatively, a knife coating method where the coating thickness is controlled by the gap height of the knife coater can be used.

Some embodiments are directed to methods for making the articles (e.g., abrasive articles) described herein. Such methods include coating a polymerizable composition layer, having a thickness, T, between a first liner and a second liner and creating a plurality of void spaces free of the polymerizable composition layer, the polymerizable composition layer comprising: a first major surface contacting the first liner; a second major surface contacting the second liner, wherein the plurality of void spaces extends into the polymerizable composition from the first major surface and the depth of the plurality of void spaces is at least 10 percent of thickness T; and a polymerizable epoxy-acrylate resin composition having a complex viscosity at 25° C. and 1 Hz frequency of about 1,000 Pa-s to about 100,000 Pa-s and a complex viscosity at 125° C. and 1 Hz frequency of about 10 Pa-s to about 10,000 Pa-s. Such methods can further comprise removing the first liner to expose the polymerizable composition layer first major surface; depositing abrasive particles on the polymerizable composition layer first major surface, wherein the abrasive particles are at least partially embedded in the polymerizable composition layer; and polymerizing the polymerizable composition layer to give a polymerized composition layer comprising a first major surface and a second major surface contacting the second liner. In some embodiments, at least one of the first liner and the second liner is a releasable liner. In some instances, the second liner is a backing. In still other instances, the second liner can be removed, e.g., after the polymerization of the composition.

Other methods include methods of making an article (e.g., an abrasive article), the method comprising: coating a polymerizable composition layer, having a thickness, T, on a liner and creating a plurality of void spaces free of the polymerizable composition layer, the polymerizable composition layer comprising: a first major surface, wherein the plurality of void spaces extends into the polymerizable composition from the first major surface and the depth of the plurality of void spaces is at least 10 percent of thickness T; a second major surface contacting the liner; and a polymerizable epoxy-acrylate resin composition having a complex viscosity at 25° C. and 1 Hz frequency of about 1,000 Pa-s to about 100,000 Pa-s and a complex viscosity at 125° C. and 1 Hz frequency of about 10 Pa-s to about 10,000 Pa-s. Such methods can further comprise depositing abrasive particles on the polymerizable composition layer first major surface, wherein the abrasive particles are at least partially embedded in the polymerizable composition layer; and polymerizing the polymerizable composition layer to give a polymerized composition layer comprising a first major surface and a second major surface contacting the liner. The liner can be a releasable liner. In some instances, the liner is a backing. In still other instances, the liner can be removed, e.g., after the polymerization of the composition.

In the methods of making articles described herein, the polymerized composition layer first major surface comprising the abrasive particles and void spaces can be coated with a curable size coat composition. The curable size coat composition, in turn, can be cured to give a cured size coat having a cured size coat first major surface and a cured size coat second major surface, wherein the cured size coat second major surface is in direct contact with substantially the entire polymerized composition layer first major surface and the cured size coat comprises a plurality of void spaces that substantially overlap with the void spaces of the polymerized composition layer.

The cured size coat can, in turn, can be coated with a curable supersize coat composition. The cured size coat first major surface comprising void spaces can be coated with a curable supersize coat composition. The curable supersize coat composition can, in turn, be cured to give a cured supersize coat having a cured supersize coat first major surface and a cured supersize coat second major surface, wherein the cured supersize coat second major surface is in direct contact with substantially the entire cured size coat first major surface and the cured supersize coat comprises void spaces that substantially overlap the void spaces of the cured size coat.

The term "alkyl" as used herein refers to straight chain and branched alkyl groups having from 1 to 40 carbon atoms ($C_1$-$C_{40}$), 1 to about 20 carbon atoms ($C_1$-$C_{20}$), 1 to 12 carbons ($C_1$-$C_{12}$), 1 to 8 carbon atoms ($C_1$-$C_8$), or, in some embodiments, from 3 to 6 carbon atoms ($C_3$-$C_6$). Examples of straight chain alkyl groups include those with from 1 to 8 carbon atoms such as methyl, ethyl, n-propyl, n-butyl, n-pentyl, n-hexyl, n-heptyl, and n-octyl groups. Examples of branched alkyl groups include, but are not limited to, isopropyl, iso-butyl, sec-butyl, t-butyl, neopentyl, isopentyl, and 2,2-dimethylpropyl groups.

The term "alkoxy" as used herein refers to the group —O-alkyl, wherein "alkyl" is defined herein.

The term "aryl" as used herein refers to cyclic aromatic hydrocarbons that do not contain heteroatoms in the ring. Thus, aryl groups include, but are not limited to, phenyl, azulenyl, heptalenyl, biphenyl, indacenyl, fluorenyl, phenanthrenyl, triphenylenyl, pyrenyl, naphthacenyl, chrysenyl, biphenylenyl, anthracenyl, and naphthyl groups. In some embodiments, aryl groups contain about 6 to about 14 carbons ($C_6$-$C_{14}$) or from 6 to 10 carbon atoms ($C_6$-$C_{10}$) in the ring portions of the groups.

The term "about" as used herein can allow for a degree of variability in a value or range, for example, within 10%, within 5%, or within 1% of a stated value or of a stated limit of a range.

Unless specified otherwise herein, the term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Unless specified otherwise herein, the term "substantially no" as used herein refers to a minority of, or mostly no, as in less than about 10%, 5%, 2%, 1%, 0.5%, 0.01%, 0.001%, or less than about 0.0001% or less.

Values expressed in a range format should be interpreted in a flexible manner to include not only the numerical values explicitly recited as the limits of the range, but also to include all the individual numerical values or sub-ranges encompassed within that range as if each numerical value and sub-range were explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. In addition, it is to be understood that the phraseology or terminology employed herein, and not otherwise defined, is for the purpose of description only and not of limitation. Any use of section headings is intended to aid reading of the document and is not to be interpreted as limiting. Further, information that is relevant to a section heading may occur within or outside of that particular section. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference should be considered supplementary to that of this document; for irreconcilable inconsistencies, the usage in this document controls.

In the methods described herein, the steps can be carried out in any order without departing from the principles of the invention, except when a temporal or operational sequence is explicitly recited. Furthermore, specified steps can be carried out concurrently unless explicit claim language recites that they be carried out separately. For example, a claimed step of doing X and a claimed step of doing Y can be conducted simultaneously within a single operation, and the resulting process will fall within the literal scope of the claimed process.

Select embodiments of the present disclosure include, but are not limited to, the following:

In a first embodiment, the present disclosure provides an abrasive layer for an abrasive article comprising:

- a body having a thickness, T, comprising:
  - a first major surface; and
  - a second major surface opposite the first major surface;
  - the body comprising a curable composition comprising:
    - (a) a polymerizable epoxy-acrylate resin composition having a complex viscosity at 25° C. and 1 Hz frequency of about 1,000 Pa-s to about 100,000

Pa-s and a complex viscosity at 125° C. and 1 Hz frequency of about 10 Pa-s to about 10,000 Pa-s; and (b) abrasive particles at least partially embedded in the polymerizable epoxy-acrylate resin composition; and wherein the body includes a plurality of void spaces free of the curable composition extending into the body from the first major surface and the depth of the plurality of void spaces is at least 10 percent of thickness T.

In a second embodiment, the present disclosure provides an abrasive layer for an abrasive article according to the first embodiment, wherein at least a portion of the plurality of void spaces extend to the second major surface.

In a third embodiment, the present disclosure provides an abrasive layer for an abrasive article according to the first or second embodiment, wherein the plurality of void spaces forms a regular or an irregular pattern.

In a fourth embodiment, the present disclosure provides an abrasive layer for an abrasive article according to any one of the first through third embodiments, wherein the polymerizable epoxy-acrylate resin composition comprises a tetrahydrofurfuryl (THF) (meth)acrylate copolymer component; one or more epoxy resins; and one or more hydroxy-functional polyethers.

In a fifth embodiment, the present disclosure provides an abrasive layer for an abrasive article according to the fourth embodiment, wherein the polymerizable epoxy-acrylate resin composition further comprises at least one polyhydroxyl-containing compound.

In a sixth embodiment, the present disclosure provides an abrasive layer for an abrasive article according to any one of the first through fifth embodiments further comprising one or more photoinitiators.

In a seventh embodiment, the present disclosure provides an abrasive layer for an abrasive article according to any one of the fourth through sixth embodiments, wherein the THF (meth)acrylate copolymer component comprises one or more THF (meth)acrylate monomers, one or more C1-C8 (meth)acrylate ester monomers, and one or more optional cationically reactive functional (meth)acrylate monomers.

In an eighth embodiment, the present disclosure provides an abrasive layer for an abrasive article according to any one of the fourth through seventh embodiments, wherein the THF (meth)acrylate copolymer component comprises polymerized monomer units of: (A) 40-60 wt % of tetrahydrofurfuryl (meth)acrylate; (B) 40-60 wt % of C1-C8 alkyl (meth)acrylate ester monomers; and (C) 0-10 wt % of cationically reactive functional monomers, wherein the sum of (A)-(C) is 100 wt % of the THF (meth)acrylate copolymer.

In a ninth embodiment, the present disclosure provides an abrasive layer for an abrasive article according to any one of the fourth through eighth embodiments, wherein the curable composition comprises: i) from about 15 to about 50 parts by weight of the THF (meth)acrylate copolymer component; ii) from about 25 to about 50 parts by weight of the one or more epoxy resins; iii) from about 5 to about 15 parts by weight of the one or more hydroxy-functional polyethers; iv) in the range of from about 10 to about 25 parts by weight of at least one polyhydroxyl-containing compound; where the sum of i) to iv) is 100 parts by weight; and v) from about 0.1 to about 5 parts by weight of a photoinitiator, relative to the 100 parts of i) to iv).

In a tenth embodiment, the present disclosure provides an abrasive layer for an abrasive article according to any one of the fourth through eighth embodiments, wherein the one or more hydroxy-functional polyethers is a liquid at a temperature of 25° C. and pressure of 1 atm (101 kilopascals).

In an eleventh embodiment, the present disclosure provides an abrasive layer for an abrasive article according to any one of the sixth through eighth embodiments, wherein the photoinitiator is a cationic photoinitiator.

In a twelfth embodiment, the present disclosure provides an abrasive layer for an abrasive article according to any one of the first through eleventh embodiments, wherein at least a portion of the abrasive particles comprise shaped abrasive particles.

In a thirteenth embodiment, the present disclosure provides an abrasive layer for an abrasive article comprising:

a body comprising:

a first major surface; and a second major surface opposite the first major surface;

wherein the body comprises the polymerization product of the curable composition according to any one of the first and fourth through eleventh embodiments and wherein the body includes a plurality of void spaces free of the polymerization product of the curable composition and the depth of the plurality of void spaces is at least 10 percent of thickness T.

In a fourteenth embodiment, the present disclosure provides an abrasive layer for an abrasive article according to the thirteenth embodiment, wherein at least a portion of the plurality of void spaces extend to the second major surface.

In a fifteenth embodiment, the present disclosure provides an abrasive layer for an abrasive article according to the thirteenth or fourteenth embodiment, wherein the polymerized epoxy-acrylate resin composition has a stiffness of from about 0.01 to about 0.2 N-mm.

In a sixteenth embodiment, the present disclosure provides an abrasive article comprising the layer according to any one of the thirteenth through fifteenth embodiments as an abrasive layer.

In a seventeenth embodiment, the present disclosure provides an abrasive article according to the sixteenth embodiment further comprising at least one of a size coat, a supersize coat, and a backing.

In an eighteenth embodiment, the present disclosure provides an abrasive article according to the seventeenth embodiment, wherein the size coat, supersize coat, or the backing comprise size coat void spaces, supersize coat void spaces, or backing void spaces, respectively, that substantially overlap with the plurality of void spaces of the abrasive layer.

In a nineteenth embodiment, the present disclosure provides an abrasive article according to the sixteenth embodiment further comprising a size coat having a size coat first major surface and a size coat second major surface, wherein the body first major surface is in direct contact with the size coat second major surface.

In a twentieth embodiment, the present disclosure provides an abrasive article according to the sixteenth embodiment further comprising a backing having a backing first major surface and a backing second major surface, wherein the backing first major surface is in direct contact with the body second major surface.

In a twenty-first embodiment, the present disclosure provides an abrasive article according to the nineteenth embodiment further comprising a supersize coat having a supersize coat first major surface and a supersize coat second major surface, wherein the supersize coat second major surface is in direct contact with the size coat first major surface.

In a twenty-second embodiment, the present disclosure provides a method of making an article, the method comprising:

coating a polymerizable composition layer, having a thickness, T, between a first liner and a second liner and creating a plurality of void spaces free of the polymerizable composition layer, the polymerizable composition layer comprising:

a first major surface contacting the first liner;

a second major surface contacting the second liner, wherein the plurality of void spaces extends into the polymerizable composition from the first major surface and the depth of the plurality of void spaces is at least 10 percent of thickness T; and a polymerizable epoxy-acrylate resin composition having a complex viscosity at 25° C. and 1 Hz frequency of about 1,000 Pa-s to about 100,000 Pa-s and a complex viscosity at 125° C. and 1 Hz frequency of about 10 Pa-s to about 10,000 Pa-s.

In a twenty-third embodiment, the present disclosure provides a method of making an article according to the twenty-second embodiment further comprising:

removing the first liner to expose the polymerizable composition layer first major surface;

depositing abrasive particles on the polymerizable composition layer first major surface, wherein the abrasive particles are at least partially embedded in the polymerizable composition layer; and polymerizing the polymerizable composition layer to give a polymerized composition layer comprising a first major surface and a second major surface contacting the second liner.

In a twenty-fourth embodiment, the present disclosure provides a method of making an article according to the twenty-third embodiment further comprising coating the polymerized composition layer first major surface comprising the abrasive particles and a plurality of void spaces with a curable size coat composition and curing the curable size coat composition to give a cured size coat having a cured size coat first major surface and a cured size coat second major surface.

In a twenty-fifth embodiment, the present disclosure provides a method of making an article according to the twenty-fourth embodiment, wherein the cured size coat second major surface is in direct contact with substantially the entire polymerized composition layer first major surface and the cured size coat comprises void spaces that substantially overlap with the void spaces of the polymerized composition layer.

In a twenty-sixth embodiment, the present disclosure provides a method of making an article according to the twenty-fifth embodiment further comprising coating the cured size coat first major surface comprising plurality void spaces with a curable supersize coat composition and curing the supersize coat composition to give a cured supersize coat having a cured supersize coat first major surface and a cured supersize coat second major surface, wherein the cured supersize coat second major surface is in direct contact with substantially the entire cured size coat first major surface.

In a twenty-seventh embodiment, the present disclosure provides a method of making an article according to the twenty-sixth embodiment, wherein the cured supersize coat comprises void spaces that substantially overlap the void spaces of the cured size coat.

In a twenty-eighth embodiment, the present disclosure provides a method of making an article according to the twenty-second through twenty-seventh embodiments, wherein at least one of the first liner and the second liner is a releasable liner.

In a twenty-ninth embodiment, the present disclosure provides a method of making an article according to the twenty-second through twenty-eighth embodiments, wherein the second liner is a backing.

In a thirtieth embodiment, the present disclosure provides a method of making an article according to the twenty-second through twenty-ninth embodiments further comprising removing the second liner.

In a thirty-first embodiment, the present disclosure provides a method of making an article, the method comprising:

coating a polymerizable composition layer, having a thickness, T, on a liner and creating a plurality of void spaces free of the polymerizable composition layer, the polymerizable composition layer comprising:

a first major surface, wherein the plurality of void spaces extends into the polymerizable composition from the first major surface and the depth of the plurality of void spaces is at least 10 percent of thickness T;

a second major surface contacting the liner; and a polymerizable epoxy-acrylate resin composition having a complex viscosity at 25° C. and 1 Hz frequency of about 1,000 Pa-s to about 100,000 Pa-s and a complex viscosity at 125° C. and 1 Hz frequency of about 10 Pa-s to about 10,000 Pa-s.

In a thirty-second embodiment, the present disclosure provides a method of making an article according to the thirty-first embodiment further comprising:

depositing abrasive particles on the polymerizable composition layer first major surface, wherein the abrasive particles are at least partially embedded in the polymerizable composition layer; and polymerizing the polymerizable composition layer to give a polymerized composition layer comprising a first major surface and a second major surface contacting the liner.

In a thirty-third embodiment, the present disclosure provides a method of making an article according to the thirty-second embodiment further comprising: further comprising coating the polymerized composition layer first major surface comprising the abrasive particles and void spaces with a curable size coat composition and curing the curable size coat composition to give a cured size coat having a cured size coat first major surface and a cured size coat second major surface, wherein the cured size coat second major surface is in direct contact with substantially the entire polymerized composition layer first major surface.

In a thirty-fourth embodiment, the present disclosure provides a method of making an article according to the thirty-third embodiment, wherein the cured size coat comprises a plurality of void spaces that substantially overlap with the void spaces of the polymerized composition layer.

In a thirty-fifth embodiment, the present disclosure provides a method of making an article according to the thirty-third or thirty-fourth embodiment further comprising coating the cured size coat first major surface comprising void spaces with a curable supersize coat composition and curing the supersize coat composition to give a cured supersize coat having a cured supersize coat first major surface and a cured supersize coat second major surface, wherein the cured supersize coat second major surface is in direct contact with substantially the entire cured size coat first major surface.

In a thirty-sixth embodiment, the present disclosure provides a method of making an article according to the thirty-fifth embodiment, wherein the cured supersize coat comprises void spaces that substantially overlap the void spaces of the cured size coat.

In a thirty-seventh embodiment, the present disclosure provides a method of making an article according to any one of the thirty-first through thirty-sixth embodiments, wherein the liner is a releasable liner.

In a thirty-eighth embodiment, the present disclosure provides a method of making an article according to any one of the thirty-first through thirty-sixth embodiments, wherein the liner is a backing.

In a thirty-ninth embodiment, the present disclosure provides a method of making an article according to any one of the thirty-first through thirty-sixth embodiments further comprising removing the liner.

EXAMPLES

The examples described herein are intended solely to be illustrative, rather than predictive, and variations in the manufacturing and testing procedures can yield different results. All quantitative values in the Examples section are understood to be approximate in view of the commonly known tolerances involved in the procedures used. The foregoing detailed description and examples have been given for clarity of understanding only. No unnecessary limitations are to be understood therefrom.

The following abbreviations are used to describe the examples:

° C.: degrees Centigrade
cm: centimeter
cm/min: centimeters per minute
g/eq.: gram equivalent
$g/m^2$: grams per square meter
in/min: inches per minute
Kg: kilogram
lb: pound
MFFT: minimum film forming temperature
min: minute
μ-inch: $10^{-6}$ inch
mm: millimeter
μm: micrometer
m/min: meters per minute
$mW/cm^2$: milliwatt per square centimeter
N: Newton
N-mm: Newton millimeter
pbw: parts by weight
rpm: revolutions per minute
$T_g$: glass transition temperature
UV: ultraviolet
$W/cm^2$: Watts per square centimeter
wt. %: weight percent Unless stated otherwise, all reagents were obtained or are available from chemical vendors such as Sigma-Aldrich Company, St. Louis, Missouri, or may be synthesized by known methods. Unless otherwise reported, all ratios are by dry weight.

Abbreviations for materials and reagents used in the examples are as follows:

| | |
|---|---|
| ACR | Trimethylolpropane triacrylate obtained under the trade designation "TMPTA" from Allnex Inc., Brussels, Belgium |
| ARCOL | A polyether polyol, obtained under the trade designation "ARCOL LHT 240" from Bayer Material Science, LLC, Pittsburgh, Pennsylvania. |
| CPI-6976 | A triarylsulfonium hexafluoroantimonate/propylene carbonate photoinitiator, obtained under the trade designation "CPI 6976" from Aceto Corporation, Port Washington, New York. |
| Devoflo 40CM X | Calcium stearate dispersion available from EChem. |
| DOWICIL QK-20 | Broad-spectrum biocide available under the trade designation "DOWICIL ANTIMICROBIALS" from DOW. |
| E-828 | A diglycidylether of bisphenol-A epoxy resin, obtained under the trade designation "EPON 828" from Momentive Specialty Chemicals, Inc., Columbus, Ohio |
| E-1001F | A diglycidylether of bisphenol-A epoxy resin, obtained under the trade designation "EPON 1001F" from Momentive Specialty Chemicals, Inc. |
| E-1510 | Biphenol-A epoxy resin having an epoxy equivalent weight of 210-220 g/eq, obtained under the trade designation "EPONEX 1510" from Momentive Specialty Chemicals, Inc. |
| GPTMS | 3-(Glycidoxypropyl) trimethoxysilane, obtained from United Chemical Technologies, Inc., Bristol, Pennsylvania. |
| HL 27 | Non-silicone antifoam obtained under the trade designation "HL-27" from Harcros Chemicals Incorporation, Kansas City, Kansas. |
| IRG | 2-hydroxy-2-methyl-1-phenyl-1-propan-1-one obtained under trade designation "IRGACURE 1173" from BASF Corporation. |
| JC LMV7051 | Styrene acrylic emulsion available under the trade designation "JONCRYL LMV 7051" from BASF Corporation. |
| KATHON CG-ICP | Biocide available under the trade designation "KATHON CG/ICP" from DOW. |
| LVPREN | Ethylene-vinyl acetate copolymer, obtained under the trade designation "LEVAPREN 700HV" from Lanxess Corporation, Pittsburgh, Pennsylvania. |
| Minex | Anhydrous sodium potassium alumino silicate obtained from Unimin Corporation, New Canaan, Connecticut |
| P180 FSX | P180 grade alumina oxide abrasive mineral, obtained under the trade designation "ALODUR BFRPL" from Imerys Fused Minerals GmbH, Villach, Austria. |
| PKHA | Phenoxy resin, obtained under the trade designation "PHENOXY PKHA" from InChem Corporation, Rock Hill, South Carolina. |
| PP | Purple pigment commercially available under the trade designation "9S93" from Penn Color, Doylestown, Pennsylvania. |

-continued

| | |
|---|---|
| SAP | Shaped abrasive particles, prepared according to the disclosure of U.S. Patent 8,142,531 (Adefris et al.). The shaped abrasive particles were prepared by molding alumina sol gel in equilateral triangle-shaped polypropylene mold cavities. After drying and firing, the resulting shaped abrasive particles were approximately 0.20 mm (side length) × 0.05 mm thick, with a draft angle of approximately 98 degrees. |
| THFA | Tetrahydrofurfuryl acrylate, V-150, obtained from San Esters Corporation, New York, New York. |
| UVR-6110 | 3,4-epoxy cyclohexylmethyl-3,4-epoxy cyclohexylcarboxylate, obtained from Daicel Chemical Industries, Ltd., Tokyo, Japan. |
| W-985 | An acidic polyester surfactant, obtained under the trade designation "BYK W-985" from Altana AG, Wesel, Germany. |
| MEK | 2-butanone (Methyl ethyl ketone) obtained from Sigma-Aldrich Company, St. Louis, MO, USA. |
| I-651 | Benzyldimethyl ketal photoinitiator, obtained under the trade designation "IRGACURE 651" from BASF Corporation. |
| IOTG | Isooctyl thioglycolate obtained from Evans Chemetics, LP, Tea neck, New Jersey |
| BA | Butyl Acrylate, available from BASF Corporation, Florham Park, New Jersey |

Rheological Test Method:

The viscoelastic characteristics of the hot melt resin (HM1 and HM2), shear storage modulus (G'), shear loss modulus (G"), and complex viscosity (η*), were measured using a TA Instruments (New Castle, DE) Discovery HR-3 rheometer. Samples of resins for rheological analysis were prepared by placing approximately 5 g of resin between two release coated polyethylene terephthalate liners (Loparex, Cary, NC) and pressing, with heating to 110° C., into 1 mm thick film by means of a hydraulic press (Carver Inc., Wabash, Indiana). A circular die punch 26 mm in diameter was used to cut individual test specimens from the pressed resin. Measurements were performed with parallel plate geometry utilizing an upper 25 mm diameter steel tool and an Advanced Peltier Plate system (TA Instruments, New Castle, DE) as the lower tool. Oscillatory temperature ramp experiments were performed from 10-150° C. at a ramp rate of 2.0° C./min. using 0.5% strain and 1 Hz frequency. A dwell time of 300 seconds at 10° C. was used to ensure thermal equilibrium in each sample before each temperature ramp and a constant compressive force of 0.1±0.15 N thorough the experiments to maintain contact between the specimen and instrument during data collection. The data in table 3 are an average of the values obtained for two independent specimens.

Abrading Test Method:

Abrasive performance testing was performed on an 18 inch by 24 inch (45.7 cm by 61 cm) black painted cold roll steel test panels having NEXA OEM type clearcoat, obtained from ACT Laboratories, Inc., Hillsdale, Michigan. For testing purposes, the abrasive discs were attached to a 6-inch (15.2 cm) backup pad, commercially available under the trade designation "HOOKIT BACKUP PAD, PART NO. 05865", from 3M Company. The tool was disposed over an X-Y table, with the test panel secured to the X-Y table.

For testing purposes, the abrasive discs were attached to the backup pad. Sanding was performed using a dual action axis of a servo controlled motor, disposed over an X-Y table, operating at 6,000 rpm, and 3/16 inch (4.76 mm) stroke, and the abrasive article urged at an angle of 2.5 degrees against the panel at a load of 15 lbs (6.80 Kg). After dulling the discs on steel at the rate of 2 inches/sec, the tool was then set to traverse in the Y direction along the length of the panel at the rate of 3.50 inches/minute (8.9 cm/minute) and in X direction at the rate of 5 inches/minute (8.9 cm/minute) along the width of the panel. Seven such passes along the length of the panel were completed in each cycle for a total of 4 cycles. The mass of the panel was measured before and after each cycle to determine the mass loss from the clear coating layer of OEM panel in grams after each cycle. Total cut was determined as the cumulative mass loss at the end of the test. See Table 4. Cut life was calculated by ratio of last minute cut divided by first minute cut for all samples.

Acrylic Copolymer 1 Preparation:

An acrylic copolymer was prepared using the method of Hamer (U.S. Pat. No. 5,804,610). Solutions were prepared by combining the acrylic monomers (BA and THFA), radical photoinitiator (I-651) and chain-transfer agent (IOTG) in an amber glass jar and swirling by hand to mix (see Table 1 for composition). The solution was divided into 25 g aliquots within heat sealed compartments of an ethylene vinyl acetate-based film, immersed in a 16° C. water bath, and polymerized using UV light (UVA=4.7 mW $cm^{-2}$, 8 min per side).

TABLE 1

Acrylic Copolymer 1 Composition.

| Component | Acrylic Copolymer 1 (parts by wt) |
|---|---|
| BA | 50 |
| THFA | 50 |
| I-651 | 0.2 |
| IOTG | 0.1 |

Hot Melt 1 (HM1) and Hot Melt 2 (HM-2) Preparation:

Acrylic Copolymer 1 was further hot-melt processed with additional components to prepare the full UV-triggered make coat compositions. Composition details are listed in Table 2. Compositions were prepared using a BRABENDER mixer (C. W. BRABENDER, Hackensack, NJ) equipped with a 50 or 250 g capacity heated mix head and kneading elements. The mixer was operated at the desired mixing temperature of 120-150° C. and the kneading elements were operated at 100 rpm. First, Acrylic Copolymer 1 was added and allowed to mix for several minutes. The E-1001F epoxy resin, LVPREN, and PKHA resins were added and allowed to mix until uniformly distributed through the mixture. The E-1510 epoxy resin, ARCOL, and GPTMS were added slowly until uniformly distributed. The resulting mixture was allowed to stir for several minutes, then CPI 6976 was added dropwise. The mixture was allowed to stir several additional minutes and was then transferred to an aluminum pan and allowed to cool, yielding HM1. Care was taken to minimize ambient light exposure of HM1. HM-2 was made similarly to HM-1, except the composition differed, as shown in Table 2.

TABLE 2

HM1 and HM2 Composition.

| Component | HM1 (parts by wt) | HM2 (parts by wt) |
|---|---|---|
| Acrylic Copolymer 1 | 32 | 32 |
| E-1510 | 19 | 19 |
| E-1001F | 19 | 19 |
| ARCOL | 10 | 10 |
| GPTMS | 1 | 1 |
| LVPREN | 10 | — |
| PKHA | 10 | — |
| CPI 6976 | 0.5 | 0.5 |

Using the Rheological Test Method, described Above, the viscoelastic properties of HM1 and HM-2 were determined. Results are shown in Table 3.

TABLE 3

Rheological data.

| | η* (Pa · s) | | G' (Pa) | | G'' (Pa) | |
|---|---|---|---|---|---|---|
| | 25° C. | 125° C. | 25° C. | 125° C. | 25° C. | 125° C. |
| HM1 | 9680.4 | 174.9 | 47501.6 | 486.4 | 37988.6 | 985.4 |
| HM2 | 2484.4 | 52.9 | 11099.4 | 135.8 | 10975.6 | 303.3 |

Make Coat 1 (MC1) Preparation:

A patterned film (see FIG. 5) of HM1 was made by casting a 3 mil thick film (76 μm) of HM1 at 120° C. onto a patterned tool to make evenly-spaced elliptical openings (2.5 mm×1.6 mm holes with hexagonal packing and an open area of 20%) in the film (the tool had the inverse pattern of the holes required for the patterned make coat film). The patterned HM1 film is then positioned onto a 76 μm (3 mil.) polyester film available under the trade designation "SCOTCHPAK" polyester film from 3M Company, St. Paul, MN.

Figure 6:
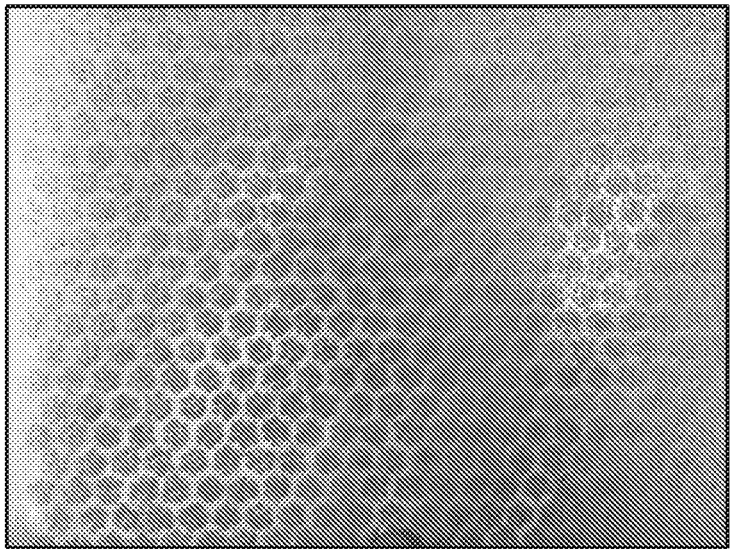
FIG. 6 is a top view of an abrasive article according to one embodiment of the present disclosure.

Make Coat 2 (MC2) Preparation:

HM1 was diluted to 50 wt. % in MEK by adding the solvent and placing on a bottle roller for 3 hours. A polyester film was laser cut in a hexagonal packing arrangement. The film had the same hole size, pattern and open area as described in MC1. The laser cut polyester film was mounted onto a 76 μm (3 mil.) polyester film available under the trade designation "SCOTCHPAK" polyester film from 3M Company, St. Paul, MN The diluted HM1 solution was poured onto the laser cut film and spread out on the film with a squeegee. The laser cut film was removed, transferring the diluted HM1 resin onto the "SCOTCHPAK" polyester film, through the open areas of laser cut film, thus resulting in a patterned make resin on the polyester backing (FIG. 6).

Size Coat 1 (SC1) Preparation:

A size resin premix was prepared by mixing 70 wt % E-1510 and 30 wt % ACR. To 55.06 wt % of this premix, 0.59 wt % W-985, 39.95 wt % Minex, 3% CPI-6976, 1% IRG, and 0.40% PP. The formulation was stirred for 30 minutes at 24° C. until homogeneous.

Supersize Coat 1 (SSC1) Preparation:

A calcium stearate based supersize was prepared by mixing 74.7% calcium stearate dispersion (Devoflo 40CM X), 12% styrene acrylic emulsion (JC LMV7051), 0.3% antifoaming agent HL27, 0.13% of DOWICIL QK-20 and 0.07% of KATHON CG-ICP as biocides in 12.8% water using high speed mixer. The formulation was stirred at 24° C. until homogeneous.

Example 1

Abrasive particle blend (prepared by mixing 10% SAP and 90% P180 FSX was coated onto the patterned make resin prepared as described in MC1 at a nominal coating weight of 105 g/m2 by electrostatic coating (Spellman SL 150). The coating was exposed to ultraviolet curing equipment (obtained from Fusion UV Systems, Gaithersburg, Maryland) with one set of D bulbs operating at 600 Watts per inch (236 Watts per centimeter). The web is then exposed to thermal curing at a nominal web temperature setting of 140° C., for about 5 minutes.

SC1 was then roll coated onto the cured make layer and abrasive particles at a nominal dry coating weight of 102 g/m2. The resultant article was exposed to ultraviolet curing (Fusion UV Systems, Gaithersburg, Maryland) with one set of D bulbs operating at 600 Watts per inch (236 Watts per centimeter). It was then processed through an oven having a target temperature of 140° C. for 5 minutes.

SSC1 was then applied over the cured size coated abrasive resin by means of a 3-roll coater, at a dry coating weight of 14 g/m$^2$, and dried for overnight at 21° C., then 5 minutes at 90° C.

After drying, an adhesive available under the trade designation "3M SUPER 77 MULTIPURPOSE ADHESIVE", from 3M Company, St. Paul, MN, was sprayed on the opposing side of the make film, and to a similar size sample of polyester based loop material available under the trade designation NASTRO VELL G75 PET from SITIP Industrie Tessili Via Caduti, 32-24020-Cene (BG) Italy. The two adhesive sides were pressed together, and air bubbles removed, using a manual roller. The resultant loop-backed abrasive coated resin was dried for overnight at 21° C., after which it was converted to 6-inch (15.24 cm) diameter discs as is known in the art. The resultant coated abrasive articles were then maintained at 24° C. and 40-60 percent relative humidity until tested.

Example 2

Abrasive particle blend (prepared by mixing 10% SAP and 90% P180 FSX was coated onto the patterned make resin prepared as described in MC2 at a nominal coating weight of 105 g/m$^2$ by electrostatic coating (Spellman SL 150). The coating was exposed to ultraviolet curing (obtained from Fusion UV Systems, Gaithersburg, Maryland) with one set of D bulbs operating at 600 Watts per inch (236 Watts per centimeter). The web is then exposed to thermal curing at a nominal web temperature setting of 140° C., for about 5 mins.

SC1 was then roll coated onto the cured make layer and abrasive particles at a nominal dry coating weight of 102 g/m$^2$. The resultant article was exposed to ultraviolet curing equipment (obtained from Fusion UV Systems, Gaithersburg, Maryland) with one set of D bulbs operating at 600 Watts per inch (236 Watts per centimeter). It was then processed through an oven having a target temperature of 140° C. for 5 minutes.

SSC1 was then applied over the cured size coated abrasive resin with a dry coating weight of 14 g/m$^2$ using roll-coat technique, then dried at temperature setting of 60-90° C. After drying, an adhesive available under the trade designation "3M SUPER 77 MULTIPURPOSE ADHESIVE", was sprayed on the opposing side of the make film, and to a similar size sample of polyester based loop material available under the trade designation NASTRO VELL G75 PET from SITIP Industrie Tessili Via Caduti, 32-24020-Cene (BG) Italy. The two adhesive sides were pressed together, and air bubbles removed, using a manual roller. The resultant loop-backed abrasive coated resin was dried for overnight at 21° C., after which it was converted to 6-inch (15.24 cm) diameter discs as is known in the art. The resultant coated abrasive articles were then maintained at 24° C. and 40-60 percent relative humidity until tested.

Comparative Example A (CE-A)

6-inch (15.24 cm) loop-backed abrasive discs, obtained under the trade designation "P180 734U", from 3M Company, St. Paul, Minnesota, were employed as comparative examples. The discs have paper-based backing.

Using the Abrading Test Method, described above, Examples 1 and 2 and Comparative Example A were tested for total cut and cut life. Results are shown in Table 4, below.

TABLE 4

Total Cut and Cut life of Example 1, Example 2 and CE-A.

| | | Abrading Time (seconds) | | | | Total | |
|---|---|---|---|---|---|---|---|
| Sample | | 60 | 120 | 180 | 240 | Cut (g) | Cut Life |
| Example 1 | Cut (g) | 6.11 | 5.00 | 4.24 | 3.65 | 19.00 | 0.60 |
| Example 2 | Cut (g) | 5.54 | 3.86 | 3.18 | 2.33 | 14.91 | 0.42 |
| CE-A | Cut (g) | 6.01 | 3.49 | 2.62 | 1.84 | 13.96 | 0.30 |

It will be apparent to those skilled in the art that the specific structures, features, details, configurations, etc., that are disclosed herein are simply examples that can be modified and/or combined in numerous embodiments. All such variations and combinations are contemplated by the inventor as being within the bounds of this disclosure. Thus, the scope of the disclosure should not be limited to the specific illustrative structures described herein, but rather extends at least to the structures described by the language of the claims, and the equivalents of those structures. To the extent that there is a conflict or discrepancy between this specification as written and the disclosure in any document incorporated by reference herein, this specification as written will control. Furthermore, all publications, patents, and patent documents referred to in this document are incorporated by reference herein in their entirety, as though they were fully set forth herein.

What is claimed is:

1. A layer for an abrasive article, the layer comprising:

a body having a thickness, T, comprising:

a first major surface; and a second major surface opposite the first major surface;

the body comprising a curable composition comprising:

(a) a polymerizable epoxy-acrylate resin composition comprising from about 15 to about 50 parts by weight of an acrylic copolymer relative to 100 parts of the curable composition and having a complex viscosity at 25° C. and 1 Hz frequency of about 1,000 Pa-s to about 100,000 Pa-s and a complex viscosity at 125° C. and 1 Hz frequency of about 10 Pa-s to about 10,000 Pa-s; and (b) abrasive particles at least partially embedded in the polymerizable epoxy-acrylate resin composition; and wherein the body includes a plurality of void spaces free of the curable composition extending into the body from the first major surface and the depth of the plurality of void spaces is at least 10 percent of thickness T.

2. The layer of claim 1, wherein at least a portion of the plurality of void spaces extend to the second major surface.

3. The layer of claim 1, wherein the plurality of void spaces forms a regular or an irregular pattern.

4. The layer of claim 1, wherein the acrylic copolymer comprises a tetrahydrofurfuryl (THF) (meth)acrylate copolymer component, and the polymerizable epoxy-acrylate resin composition further comprises one or more epoxy resins and one or more hydroxy-functional polyethers.

5. The layer as in claim 4, wherein the polymerizable epoxy-acrylate resin composition further comprises at least one polyhydroxyl-containing compound.

6. The layer of claim 1, further comprising one or more photoinitiators.

7. The layer of claim 4, wherein the THF (meth)acrylate copolymer component comprises one or more polymerized THF (meth)acrylate monomers, one or more polymerized $C_1$-$C_8$ (meth)acrylate ester monomers, and one or more optional polymerized cationically reactive functional (meth) acrylate monomers.

8. The layer of claim 4, wherein the THF (meth)acrylate copolymer component comprises polymerized monomer units of: (A) 40-60 wt % of tetrahydrofurfuryl (meth) acrylate; (B) 40-60 wt % of $C_1$-$C_8$ alkyl (meth)acrylate ester monomers; and (C) 0-10 wt % of cationically reactive functional monomers, wherein the sum of (A)-(C) is 100 wt % of the THF (meth)acrylate copolymer.

9. The layer of claim 4, wherein the curable composition comprises: i) the acrylic copolymer; ii) from about 25 to about 50 parts by weight of the one or more epoxy resins; iii) from about 5 to about 15 parts by weight of the one or more hydroxy-functional polyethers; iv) in the range of from about 10 to about 25 parts by weight of at least one polyhydroxyl-containing compound; where the sum of i) to iv) is 100 parts by weight; and v) from about 0.1 to about 5 parts by weight of a photoinitiator, relative to the 100 parts of i) to iv).

10. The layer of claim 4, wherein the one or more hydroxy-functional polyethers is a liquid at a temperature of 25° C. and pressure of 1 atm (101 kilopascals).

11. The layer of claim 6, wherein the photoinitiator is a cationic photoinitiator.

12. The layer of claim 1, wherein at least a portion of the abrasive particles comprise shaped abrasive particles.

13. A layer for an abrasive article, the layer comprising:

a body comprising:

a first major surface;

a second major surface opposite the first major surface;

wherein the body comprises the polymerization product of the curable composition according to claim 1 and wherein the body includes a plurality of void spaces free of the polymerization product of the curable composition and the depth of the plurality of voids is spaces is at least 10 percent of thickness T.

14. The layer of claim 13, wherein at least a portion of the plurality of void spaces extend to the second major surface.

15. The layer of claim 13, wherein the polymerized epoxy-acrylate resin composition has a stiffness of from about 0.01 to about 0.2 N-mm.

16. An abrasive article comprising the layer as in claim 13 as an abrasive layer.

17. The abrasive article of claim 16, further comprising at least one of a size coat, a supersize coat, and a backing.

18. The abrasive article of claim 17, wherein the size coat, supersize coat, or the backing comprise size coat void spaces, supersize coat void spaces, or backing void spaces, respectively, that substantially overlap with the plurality of void spaces of the abrasive layer.

19. The abrasive article of claim 16, further comprising a size coat having a size coat first major surface and a size coat second major surface, wherein the body first major surface is in direct contact with the size coat second major surface.

20. The abrasive article of claim 16, further comprising a backing having a backing first major surface and a backing second major surface, wherein the backing first major surface is in direct contact with the body second major surface.

21. The abrasive article of claim 19, further comprising a supersize coat having a supersize coat first major surface and a supersize coat second major surface, wherein the supersize coat second major surface is in direct contact with the size coat first major surface.

* * * * *